US005436121A

United States Patent [19]

Suga et al.

[11] Patent Number: 5,436,121

[45] Date of Patent: Jul. 25, 1995

[54] SILVER HALIDE COLOR PHOTOGRAPHIC LIGHT-SENSITIVE MATERIAL

[75] Inventors: Yoichi Suga; Junji Nishigaki; Takanori Hioki, all of Minami-Ashigara, Japan

[73] Assignee: Fuji Photo Film Co., Ltd., Kanagawa, Japan

[21] Appl. No.: 345,752

[22] Filed: Nov. 22, 1994

[30] Foreign Application Priority Data

Nov. 22, 1993 [JP] Japan ..... 5-313988

[51] Int. Cl.[6] ..... G03C 1/46

[52] U.S. Cl. ..... 430/504; 430/508; 430/503; 430/574; 430/583; 430/580; 430/578

[58] Field of Search ..... 430/504, 508, 503, 574, 430/583, 580, 578, 582

[56] References Cited

U.S. PATENT DOCUMENTS

| | | | |
|---|---|---|---|
| 2,313,922 | 3/1943 | Carroll et al. | 430/576 |
| 3,933,510 | 1/1976 | Shiba et al. | 430/574 |
| 3,953,215 | 4/1976 | Hinata et al. | 430/574 |
| 3,977,883 | 8/1976 | Hinata et al. | 430/574 |
| 4,663,271 | 5/1987 | Nozawa et al. | 430/504 |
| 4,705,744 | 11/1987 | Sasaki et al. | 430/504 |
| 5,288,738 | 2/1994 | Vishwakarma et al. | 430/578 |

FOREIGN PATENT DOCUMENTS

| | | | |
|---|---|---|---|
| 0588130 | 3/1994 | European Pat. Off. | 430/504 |
| 1219016 | 1/1971 | United Kingdom . | |

*Primary Examiner*—Thomas R. Neville
*Attorney, Agent, or Firm*—Birch, Stewart, Kolasch & Birch

[57] ABSTRACT

Disclosed is a silver halide color photographic light-sensitive material which includes, on a support, at least one blue-sensitive silver halide emulsion layer containing a yellow coupler, at least one green-sensitive silver halide emulsion layer containing a magenta coupler, and at least one red-sensitive silver halide emulsion layer containing a cyan coupler, and in which a weight-averaged wavelength ($\lambda_R$) of a spectral sensitivity distribution of magnitude of an interimage effect which the silver halide emulsion layers except for all of the red-sensitive silver halide emulsion layers have on the red-sensitive layers over a range of 500 to 600 nm is 500 nm$<\lambda_R<$560 nm, and a difference between weight-averaged wavelength ($\lambda_G$) of a spectral sensitivity distribution of at least one green-sensitive silver halide emulsion layer and $\lambda_R$ is $\lambda_G-\lambda_R\leqq 10$ nm, wherein at least one silver halide emulsion layer having the interimage effect on the red-sensitive silver halide emulsion layers is made contains a silver halide emulsion spectrally sensitized with at least one compound represented by Formula (I) below and at least one compound represented by Formula (II) below.

Formula (I)

$(MET)_{k1}-(Q)_{k2}-(ST)]_{k3}$

Formula (II)

14 Claims, 1 Drawing Sheet

SILVER HALIDE COLOR PHOTOGRAPHIC LIGHT-SENSITIVE MATERIAL

BACKGROUND OF THE INVENTION

1. Field of the Invention

The present invention relates to a silver halide photographic light-sensitive material and, more particularly, to a silver halide color photographic light-sensitive material having a high color reproduction and which is improved in storage stability and resistance to pressure after photographing.

2. Description of the Related Art

It is conventionally known to use an interlayer inhibiting effect as a means of improving the color reproduction of color photographic light-sensitive materials. In the case of a color negative sensitive material, by giving a development inhibiting effect from a green-sensitive silver halide emulsion layer (to be also referred to as a green-sensitive layer hereinafter) to a red-sensitive silver halide emulsion layer (to be also referred to as a red-sensitive layer hereinafter), it is possible to suppress the degree of color generation of the red-sensitive layer upon white-light exposure to be lower than that upon red-light exposure. In a color negative paper system, the gradation is so balanced that gray is reproduced on a color print when the system is exposed to white light. For this reason, an interimage effect (also called an interlayer effect) gives rise to cyan color generation at a higher density upon red exposure than upon gray exposure. This makes it possible to provide a higher-saturation red reproduction with a suppressed cyan color generation on a print. Likewise, a development inhibiting effect from a red-sensitive layer to a green-sensitive layer gives rise to green reproduction with a high saturation.

When the saturations of the primary colors, red, green, and blue, are increased by using these methods, the hues of colors from yellow to cyan green cannot be reproduced faithfully. A technique described in JP-A-61-34541 ("JP-A" means Unexamined Published Japanese Patent Application) has been proposed as a countermeasure against this problem. The purpose of this technique is to achieve a vivid, faithful color reproduction by using a silver halide color light-sensitive material having on a support at least one blue-sensitive silver halide emulsion layer (hereinafter referred to as the "blue-sensitive layer") containing a yellow coupler, at least one green-sensitive silver halide emulsion layer containing a magenta coupler, and at least one red-sensitive silver halide emulsion layer containing a cyan coupler, wherein the weight-averaged wavelength ($\lambda_G$) of the spectral sensitivity distribution of the green-sensitive silver halide emulsion layer is 520 nm$<\lambda_G\leqq$580 nm, the weight-averaged wavelength ($\lambda_{-R}$) of the spectral sensitivity distribution of the magnitude of the interlayer effect which the silver halide emulsion layers except for all of the red-sensitive silver halide emulsion layers containing cyan couplers have on the red-sensitive layers over the range of 500 to 600 nm is 500 nm$<\lambda_{-R}\leqq$560 nm, and $\lambda_G-\lambda_{-R}\leqq$10 nm. The weight-averaged wavelength $\lambda_{-R}$ of the wavelength distribution of the magnitude of the interlayer effect that the silver halide emulsion layers except for the red-sensitive silver halide emulsion layers have on the red-sensitive layers over the range of 500 to 600 nm is obtained as follows.

(1) First, red-sensitive layers for generating cyan are fogged to some appropriate value with uniform exposure by using a red filter for transmitting a specific wavelength or higher or an interference filter for transmitting only a specific wavelength, so that the red-sensitive layers for generating cyan are sensitized and other layers are not sensitized at a wavelength of 600 nm or higher.

(2) Subsequently, by giving spectral exposure, the development inhibiting interlayer effect of blue-sensitive layers and green-sensitive layers acts on the fogged red-sensitive layers, forming a reversal image (see FIG. 1A).

(3) From this reversal image, the spectral sensitivity distribution $S_{-R}(\lambda)$ as a reversal sensitive material is obtained. ($S_{-R}(\lambda)$ for a specific wavelength $\lambda$ is obtained at a relative point from a point a shown in FIG. 1A.)

(4) The barycentric wavelength ($\lambda_{-R}$) of the interlayer effect is calculated using Equation (1) below:

$$\lambda_{-R} = \frac{\int_{500\text{ nm}}^{600\text{ nm}} \lambda \cdot S_{-R}(\lambda)d\lambda}{\int_{500\text{ nm}}^{600\text{ nm}} S_{-R}(\lambda)d\lambda} \qquad \text{Equation 1}$$

The barycentric sensitivity wavelength $\lambda_G$ herein mentioned is given by the following equation.

$$\lambda_G = \frac{\int_{500\text{ nm}}^{600\text{ nm}} \lambda \cdot S_G(\lambda)d\lambda}{\int_{500\text{ nm}}^{600\text{ nm}} S_G(\lambda)d\lambda}$$

$S_G(\lambda)$ is the spectral sensitivity distribution curve of the green-sensitive layer. A relative value of $S_G(\lambda)$ at the particular wavelength $\lambda$ is obtained from a point b in FIG. 1B.

JP-A-61-34541 has disclosed a light-sensitive material in which a donor layer having an interlayer effect on red-sensitive layers is arranged in order to obtain the interlayer effect discussed above. A sensitizing dye used in this layer is so designed as to have an effect on the short-wavelength side of green-sensitive layers. Unfortunately, it has become evident that, since the adsorption of the sensitizing dye to silver halide grains is not sufficiently strong, the desorption of the sensitizing dye from silver halide grains takes place if the light-sensitive material is stored under high-temperature, high-humidity conditions, with the result that no satisfactory color reproduction can be obtained.

Monomethinecyanine containing a 2-quinoline skeleton has a maximum value of spectral sensitivity at 520 to 545 nm. However, monomethinecyanine is used in combination with benzoimidazolocarbocyanine or with oxacarbocyanine since a low sensitivity results if monomethinecyanine is used singly (e.g., JP-B-56-24939 ("JP-B" means Examined Published Japanese Patent Application), JP-B-56-38936, JP-B-56-38940, and British Patent 1,219,016). Unfortunately, these methods cannot provide a high color reproduction because the spectral sensitivity region shifts to longer wavelengths.

SUMMARY OF THE INVENTION

It is an object of the present invention to provide a silver halide color photographic light-sensitive material having a high color reproduction and which is improved in storage stability and resistance to pressure after photographing.

The above object of the present invention is achieved by, (1) A silver halide color photographic light-sensitive material which comprises, on a support, at least one blue-sensitive silver halide emulsion layer containing a yellow coupler, at least one green-sensitive silver halide emulsion layer containing a magenta coupler, and at least one red-sensitive silver halide emulsion layer containing a cyan coupler, and in which a weight-averaged wavelength ($\lambda_{-R}$) of a spectral sensitivity distribution of magnitude of an interimage effect which the silver halide emulsion layers except for all of the red-sensitive silver halide emulsion layers have on the red-sensitive layers over a range of 500 to 600 nm is 500 nm$<\lambda_{-R}<$560 nm, and a difference between a weight-averaged wavelength ($\lambda_G$) of a spectral sensitivity distribution of at least one green-sensitive silver halide emulsion layer and $\lambda_{-R}$ is $\lambda_G-\lambda_{-R}\geqq 10$ nm, wherein at least one silver halide emulsion layer having the interimage effect on the red-sensitive silver halide emulsion layers is made contains a silver halide emulsion spectrally sensitized with at least one compound represented by Formula (I) below and at least one compound represented by Formula (II) below:

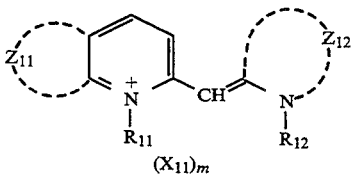

Formula (I)

wherein each of $R_{11}$ and $R_{12}$ represents an alkyl group, $Z_{11}$ represents a group of atoms required to form a benzene ring, $Z_{12}$ represents a group of atoms required to form a benzothiazole nucleus or a benzoselenazole nucleus, $X_{11}$ represents a charge-balancing counterion, and m represents 0 or m being 0 when an intramolecular salt is to be formed;

$$(MET)_{k1}-(Q)_{k2}-(ST)]_{k3}$$

Formula (II)

wherein MET represents a group of atoms having a methine dye structure, Q represents a divalent linking group consisting of an atom or an atomic group containing at least one of a carbon atom, a nitrogen atom, a sulfur atom, or an oxygen atom, ST represents a group of atoms having a styryl base structure, each of $k_1$ and $k_3$ is an integer of not less than 0, and $k_2$ is 0 or 1, and (2) The silver halide color photographic light-sensitive material described in item (1) above, containing a silver halide emulsion spectrally sensitized with at least one compound represented by Formula (I) above, at least one compound represented by Formula (II) above, and at least one compound represented by Formula (III) below:

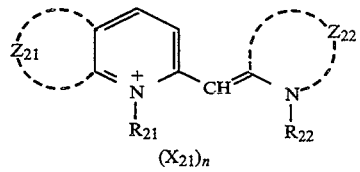

Formula (III)

wherein $R_{21}$, $R_{22}$, $Z_{21}$, $X_{21}$, and n have the same meanings as $R_{11}$, $R_{12}$, $Z_{11}$, $X_{11}$, and m, respectively, in Formula (I), and $Z_{22}$ represents a group of atoms required to form a benzoxazole nucleus or a naphthoxazole nucleus.

DETAILED DESCRIPTION OF THE PREFERRED EMBODIMENTS

Figure 1A:
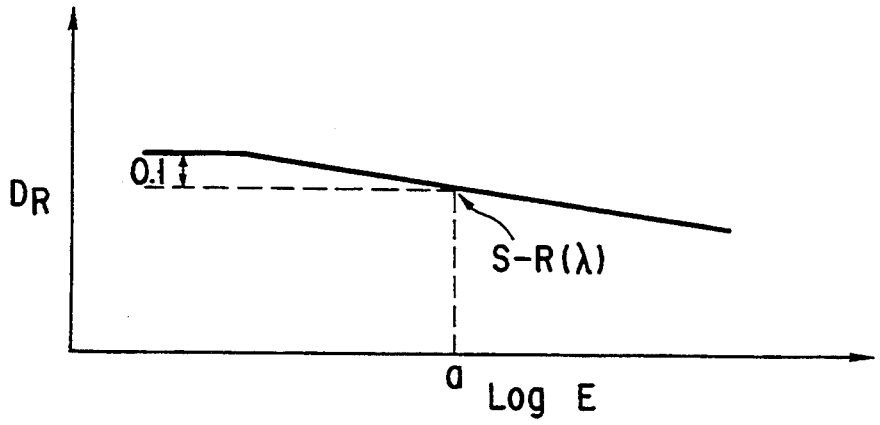
FIG. 1A is a diagram showing the spectral sensitivity distribution curve of a red-sensitive layer.
Figure 1B:
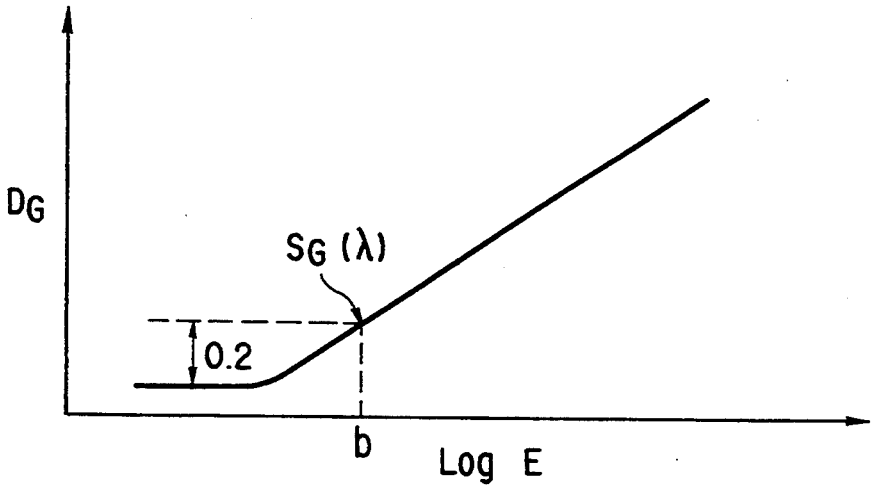
FIG. 1B is a diagram showing the spectral sensitivity distribution curve of a green-sensitive layer.

The present invention will be described in more detail below.

It is known to use an interlayer inhibiting effect as a means of improving the color reproduction of color photographic light-sensitive materials. JP-A-61-34541 has tried to achieve a vivid, faithful color reproduction by using a silver halide color light-sensitive material in which the weight-averaged wavelength ($\lambda_G$) of the spectral sensitivity distribution of green-sensitive silver halide emulsion layers is 520 nm$<\lambda_G\leqq$580 nm, the weight-averaged wavelength ($\lambda_{-R}$) of the spectral sensitivity distribution of the magnitude of the interlayer effect which silver halide emulsion layers except for red-sensitive silver halide emulsion layers have on the red-sensitive layers over the range of 500 to 600 nm is 500 nm$<\lambda_{-R}\leqq$560 nm, and $\lambda_G-\lambda_{-R}\leqq 10$ nm. This technique has suggested to allow the interlayer effect to act on the red-sensitive layers only from the short-wavelength side of the green-sensitive layers, whereas the interlayer effect is conventionally permitted to act on red-sensitive layers from the entire wavelength region of green-sensitive layers. As a sensitizing dye having spectral absorption on the short-wavelength side of green-sensitive layers, an oxacarbocyanine dye is commonly used in this field of art. An oxacarbocyanine dye has a high absorption and an enhanced adsorption to a silver halide since the dye forms a J associated body. It is difficult to shift the absorption of this J associated body 15 to 30 nm to shorter wavelengths than those of conventional dyes used in green-sensitive layers. Therefore, it is necessary to shorten the wavelength by using a structural modification which hardly forms a J associated body. Since the destruction of a J associated body weakens the adsorption to a silver halide, some countermeasure for strengthening the adsorption is required. A representative example of a means of strengthening the adsorption is a method of modifying the surface of a silver halide grain with iodide. Unfortunately, enhancing the adsorption of a sensitizing dye with this method leads to problems such as degradation in pressure-induced fog or a decrease in the sensitivity of an undeveloped film during storage after photographing.

The present inventors searched for a sensitizing dye which formed a J associated body and had a spectral absorption whose wavelength was 15 to 30 nm shorter than those of conventional green-sensitive sensitizing dyes. Consequently, a 2-quinolinemonomethine-based sensitizing dye represented by Formula (I) was found. However, it was not possible to obtain a desired sensitivity by this sensitizing dye because the relative quantum yield ($\phi\tau$) of the dye was low due to its low LUMO. As a means of increasing $\phi\tau$, a method is known in which a compound (supersensitizer) having $E_{OX}$ which is baser than $E_{OX}$ of a sensitizing dye represented by Formula (I) is used together with the dye. A styryl-base compound and a ferrocene compound are examples of this supersensitizer. Unfortunately, no satisfactory storage stability could be obtained since the adsorption of these compounds themselves to a silver halide was weak.

The present inventor's therefore have made extensive studies and found that it is possible to achieve a high sensitivity and at the same time a high storage stability and a high resistance to pressure by using a compound formed by bonding a methine dye and a styryl base.

First, a compound represented by Formula (I) will be described in detail below.

Formula (I)

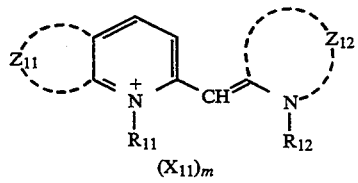

In Formula (I), $Z_{11}$ represents a group of atoms required to form a benzene ring. At least one atom of these group of atoms may be substituted with an alkyl group having 1 to 8 carbon atoms, preferably 1 to 5 carbon atoms, more preferably 1 to 3 carbon atoms, an alkoxy group having 1 to 8 carbon atoms, preferably 1 to 5 carbon atoms, more preferably 1 to 3 carbon atoms, or an aryloxy group having 6 to 20 carbon atoms, preferably 6 to 15 carbon atoms, more preferably 6 to 10 carbon atoms. Preferably, the 6-position of the benzene ring formed by Z11 is substituted with an alkyl group having 1 to 3 carbon atoms. Examples of the alkyl group by which $Z_{11}$ is substituted are methyl, ethyl, n-propyl, isopropyl, t-butyl, n-butyl, n-octyl, n-decyl, n-hexadecyl, cyclopentyl, and cyclohexyl. The alkyl group is preferably methyl or ethyl.

The alkoxy group by which $Z_{11}$ is substituted is, e.g., methoxy, ethoxy, propoxy, or methylenedioxy, and preferably methoxy.

The aryloxy group by which $Z_{11}$ is substituted is, e.g., phenoxy, 4-methylphenoxy, or 4-chlorophenoxy, and preferably phenoxy.

$Z_{12}$ represents a group of atoms required to form a benzothiazole nucleus or a benzoselenazole nucleus. These group of atoms may have substituents. $Z_{12}$ preferably represents a benzothiazole nucleus whose 5-position is substituted with a halogen atom, an alkyl group having 1 to 8 carbon atoms, preferably 1 to 5 carbon atoms, more preferably 1 to 3 carbon atoms, an alkoxy group having 1 to 8 carbon atoms, preferably 1 to 5 carbon atoms, more preferably 1 to 3 carbon atoms, an alkylthio group having 1 to 8 carbon atoms, preferably 1 to 5 carbon atoms, more preferably 1 to 3 carbon atoms, or an aryl group having 6 to 20 carbon atoms, preferably 6 to 15 carbon atoms, more preferably 6 to 10 carbon atoms. Examples of the halogen atom by which the benzothiazole nucleus is substituted are a fluorine atom, chlorine atom, a bromine atom, and an iodine atom. The halogen atom is preferably a bromine atom or a chlorine atom.

The alkyl group may have a substituent. Examples of the alkyl group are methyl, ethyl, n-propyl, isopropyl, t-butyl, n-butyl, n-octyl, n-decyl, n-hexadecyl, cyclopentyl, cyclohexyl, trifluoromethyl, and hydroxyethyl. The alkyl group is preferably trifluoromethyl.

The alkoxy group is, e.g., methoxy, ethoxy, propoxy, or methylenedioxy, and preferably methoxy.

The alkylthio group is, e.g., methylthio, ethylthio, or propylthio, and preferably methylthio.

The aryl group is, e.g., phenyl, pentafluorophenyl, 4-chlorophenyl, 3-sulfophenyl, or 4-methylphenyl, and preferably phenyl.

In Formula (I), each of $R_{11}$ and $R_{12}$ represents a nonsubstituted alkyl group (e.g., methyl, ethyl, propyl, butyl, pentyl, octyl, decyl, dodecyl, and octadecyl) having 18 or less carbon atoms, or a substituted alkyl group {i.e., an alkyl group having 18 or less carbon atoms and substituted with, e.g., a carboxy group, a sulfo group, a cyano group, a halogen atom (e.g., fluorine, chlorine, and bromine), a hydroxy group, an alkoxycarbonyl group (e.g., methoxycarbonyl, ethoxycarbonyl, and benzyloxycarbonyl) having 8 or less carbon atoms, an alkanesulfonylaminocarbonyl group having 8 or less carbon atoms, an acylaminosulfonyl group having 8 or less carbon atoms, an alkoxy group (e.g., methoxy, ethoxy, benzyloxy, and phenethyloxy) having 8 or less carbon atoms, an alkylthio group (e.g., methylthio, ethylthio, and methylthioethylthioethyl) having 8 or less carbon atoms, an aryloxy group (e.g., phenoxy, p-tolyloxy, 1-naphthoxy, and 3-naphthoxy) having 20 or less carbon atoms, an acyloxy group (e.g., acetyloxy and propionyloxy) having 3 or less carbon atoms, an acyl group (e.g., acetyl, propionyl, and benzoyl) having 8 or less carbon atoms, a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), or an aryl group (e.g., phenyl, 4-chlorophenyl, 4-methylphenyl, and $\alpha$-naphthyl) having 20 or less carbon atoms.

Each of $R_{11}$ and $R_{12}$ is preferably a nonsubstituted alkyl group (e.g., methyl, ethyl, n-propyl, n-butyl, n-pentyl, and n-hexyl), a carboxyalkyl group (e.g., 2-carboxyethyl and carboxymethyl), or a sulfoalkyl group (e.g., 2-sulfoethyl, 3-sulfopropyl, 4-sulfobutyl, and 3-sulfobutyl).

The alkyl group represented by $R_{11}$ and $R_{12}$ is more preferably sulfoethyl, sulfopropyl, sulfobutyl, carboxymethyl, or carboxyethyl.

In Formula (I), $X_{11}$ represents a charge-balancing counterion. An ion which counterbalances an intramolecular charge is selected from anions or cations. Examples of the anions are an inorganic or organic acid anion (e.g., p-toluenesulfonate, p-nitrobenzenesulfonate, methanesulfonate, methylsulfate, ethylsulfate, and perchlorate), and a halogen ion (e.g., chloride, bromide, and iodide). The cations include both inorganic and organic cations. Examples of the cations are hydrogen ion, alkali metal ions (e.g., ions of lithium, sodium, potassium, and cesium), alkali earth metal ions (e.g., ions of magnesium, calcium, and strontium), and ammonium ions (e.g., ions of organic ammonium, triethanolammonium, and pyridinium).

m represents 0 or 1. When intramolecular salt is to be formed, m is 0.

A compound represented by Formula (II) will be described in more detail below.

$$(MET)_{k1}-(Q)_{k2}-(ST)]_{k3} \qquad \text{Formula (II)}$$

In Formula (II), a group indicated by MET represents any of a cyanine structure formed by linking a nitrogen-containing heterocyclic ring, which is generally called a basic nucleus, to another nitrogen-containing heterocyclic ring via a conjugate double bond such that the two heterocyclic rings conjugate each other; a merocyanine structure formed by linking a heterocyclic ring, which is called an acidic nucleus, to a basic nucleus via a conjugate double bond such that a carbonyl group in the acidic nucleus and a nitrogen atom in the basic nucleus conjugate each other; a rhodacyanine structure having both of these structures; an oxynol structure; a hemicyanine structure; a styryl structure; and a benzylidene structure.

Examples of these polymethine dyes are described in, e.g., T. H. James ed., "The Theory of The Photographic Process," 1977, Macmillan, Chapter 8, and D. M. Sturmer, "The Chemistry of Heterocyclic Compounds," A. Wiessberger and E. C. Taylor ed., 1977, John Wiley and Sons (New York).

A group indicated by ST represents a styryl-base structure.

Details of the styryl base are described in, e.g., "The Chemistry of Heterocyclic Compounds" cited above, Chapter 13, pages 433 to 436, U.S. Pat. Nos. 2,313,922, 2,075,046, 2,448,858, and 2,680,686, British Patent 1,230,449, and Belgian Patent 771,168.

Q represents a divalent linking group consisting of an atom or an atomic group containing at least one of a carbon atom, a nitrogen atom, a sulfur atom, or an oxygen atom.

Q preferably represents a divalent linking group having 20 or less carbon atoms and constituted by one or a combination of an alkylene group (e.g., methylene, ethylene, propylene, butylene, and pentylene), an arylene group (e.g., phenylene and naphthylene), an alkenylene group (e.g., ethenylene and propenylene), an amido group, an ester group, a sulfoamido group, a sulfonate group, a ureido group, a sulfonyl group, a sulfinyl group, a thioether group, an ether group, a carbonyl group, —N($R^1$)— (wherein $R^1$ represents a hydrogen atom, a substituted or nonsubstituted alkyl group, or a substituted or nonsubstituted aryl group), and a heterocyclic divalent group (e.g., 6-chloro-1,3,5-triazine-2,4-diyl, pyrimidine-2,4-diyl, and quinoxaline-2,3-diyl). Q is more preferably an ester group or an amido group.

Each of $k_1$ and $k_3$ is an integer of not less than 0, and $k_2$ is 0 or 1.

$k_1$ is preferably 1 or 2, and $k_3$ is preferably 1, 2, 3, or 4. More preferably, $k_1$, $k_2$, or $k_3$ is 1.

A cyanine structure which is favorably used as MET in the present invention is represented by Formula (IV) or (V) below:

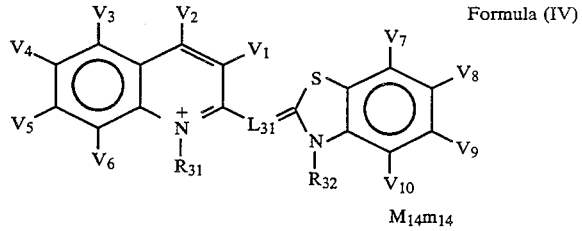

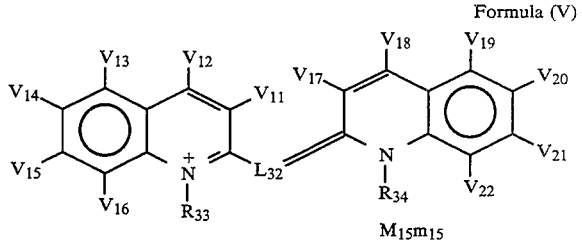

In Formulas (IV) and (V), each of $R_{31}$, $R_{32}$, $R_{33}$, and $R_{34}$ represents an alkyl group having 1 to 18 carbon atoms, preferably 1 to 10 carbon atoms, more preferably 1 to 5 carbon atoms, and each of $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, and $V_{22}$ represents a hydrogen atom or a monovalent substituent group.

Each of $L_{31}$ and $L_{32}$ represents a methine group.

Each of $M_{14}$ and $M_{15}$ represents a charge-neutralizing counterion, and each of $m_{14}$ and $m_{15}$ represents a number equal to or larger than 0 which is needed to neutralize an intramolecular charge.

Note that each of Formulas (IV) and (V) is substituted with at least one —$(Q)_{k2}$—$(ST)_{k3}$.

The details of the structures of Formulas (IV) and (V) will be described below.

$R_{31}$, $R_{32}$, $R_{33}$, and $R_{34}$ are identical with $R_{11}$, $R_{12}$, $R_{13}$, $R_{21}$, and $R_{22}$.

Each of $V_1$ to $V_{22}$ represents a hydrogen atom or a monovalent substituent group. Although this substituent group can be any substituent, preferred examples are as follows.

That is, the preferred examples are a non-substituted alkyl group (e.g., methyl, ethyl, propyl, isopropyl, butyl, isobutyl, hexyl, octyl, dodecyl, octadecyl, cyclopentyl, cyclopropyl, and cyclohexyl) having 1 to 18 carbon atoms, preferably 1 to 10 carbon atoms, more preferably 1 to 5 carbon atoms, a substituted alkyl group {assuming that the substituent is V, examples of the substituent indicated by V are, although they are not particularly limited, a carboxy group, a sulfo group, a cyano group, a halogen atom (e.g., a fluorine atom, a chlorine atom, a bromine atom, and an iodine atom), a hydroxy group, an alkoxycarbonyl group (e.g., methoxycarbonyl, ethoxycarbonyl, phenoxycarbonyl, and benzyloxycarbonyl) having 2 to 20 carbon atoms, preferably 2 to 10 carbon atoms, more preferably 2 to 6 carbon atoms, an alkoxy group (e.g., methoxy, ethoxy, benzyloxy, and phenethyloxy) having 1 to 18 carbon atoms, preferably 1 to 10 carbon atoms, more preferably 1 to 5 carbon atoms, an aryloxy group (e.g., phenoxy, 4-methylphenoxy, and α-naphthoxy) having 18 or less carbon atoms, an acyloxy group (e.g., acetyloxy and propionyloxy) having 2 to 20 carbon atoms, preferably 2 to 10 carbon atoms, more preferably 2 to 6 carbon atoms, an acyl group (e.g., acetyl, propionyl, benzoyl, and mesyl) having 2 to 20 carbon atoms, preferably 2 to 10 carbon atoms, more preferably 2 to 6 carbon atoms, a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), an aryl group (e.g., phenyl, 4-chlorophenyl, 4-methylphenyl, and α-naphthyl) having 6 to 20 carbon atoms, preferably 6 to 15 carbon atoms, more preferably 6 to 10 carbon atoms, a heterocyclic group (e.g., 2-pyridyl, tetrahydrofurfuryl, morpholino, and 2-thiopheno) having 1 to 20 carbon atoms, preferably 2 to 10 carbon atoms, more preferably 3 to 6 carbon atoms, an amino group (e.g., amino, dimethylamino, anilino, and diphenylamino), an alkylthio group (e.g., methylthio and ethylthio), an alkylsulfonyl group (e.g., methylsulfonyl and propylsulfonyl), an alkylsulfinyl group (e.g., methylsulfinyl), a nitro group, a phosphoric acid group, an acylamino group (e.g., acetylamino), an ammonium group (e.g., trimethylammonium and tributylammonium), a mercapto group, a hydrazino group (e.g., trimethylhydrazino), a ureido group (e.g., ureido and N,N-dimethylureido), an imido group, and an unsaturated hydrocarbon group (e.g., vinyl, ethynyl, 1-cyclohexenyl, benzylidine, and benzylidene). The number of carbon atoms of the substituent V is favorably 18 or less. These substituents may be further substituted with V}, a nonsubstituted aryl group (e.g., phenyl and 1-naphthyl) having 6 to 10 carbon atoms, a substituted aryl group (an example of the substituent is V discussed above) having 6 to 10 carbon atoms, a nonsubstituted heterocyclic group (e.g., 2-pyridyl, 2-thiazolyl, morpholino, 2-thiopheno) having 3 to 6 carbon atoms, and a substituted heterocyclic group (an example of the substituent is V) having 3 to 6 carbon atoms, and the substituent represented by V mentioned above.

More specifically, the preferred examples are an alkyl group (e.g., methyl, ethyl, carboxymethyl, 2-carboxyethyl, 3-carboxypropyl, 4-carboxybutyl, sulfomethyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 4-hydroxybutyl, 2,4-dihydroxybutyl, 2-methoxyethyl, 2-ethoxyethyl, methoxymethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3-aminopropyl, dimethylaminomethyl, 3-dithylaminopropyl, methylthiomethyl, 2-methylsulfonylethyl, methylsulfinylmethyl, 2-acetylaminoethyl, acetylaminomethyl, trimethylammoniummethyl, 2-mercaptoethyl, 2-trimethylhydrazinoethyl, methylsulfonylcarbamoylmethyl, and (2-methoxy)ethoxymethyl), an aryl group (e.g., phenyl, 1-naphthyl, and p-chlorophenyl), a heterocyclic group (e.g., 2-pyridyl, 2-thiazolyl, and 4-phenyl-2-thiazolyl), and a substituent represented by V (e.g., carboxyl, formyl, acetyl, benzoyl, 3-carboxypropanoyl, 3-hydroxypropanoyl, a chlorine atom, N-phenylcarbamoyl, N-butylcarbamoyl, boric acid, sulfo, cyano, hydroxy, methoxy, methoxycarbonyl, acetyloxy, and dimethylamino).

Of $V_1$ to $V_{10}$, two neighboring substituent groups may be bonded to each other to form a ring. These rings may be either of aliphatic group or aromatic group. Also, these rings may be further substituted with, e.g., the substituent V discussed above.

A methine dye structure represented by Formula (IV) or (V) is substituted with at least one $-(Q)_{k2}-(ST)_{k3}$.

The position of the substitution can be any of $R_{31}$, $R_{32}$, $R_{33}$, and $R_{34}$, $V_1$ to $V_{22}$, and $L_{31}$ and $L_{32}$. A preferable substitution is to alkyl groups represented by $R_{31}$, $R_{32}$, $R_{33}$, and $R_{34}$.

A styryl-base structure preferably used as ST in the present invention is represented by Formula (VI):

Formula (VI)

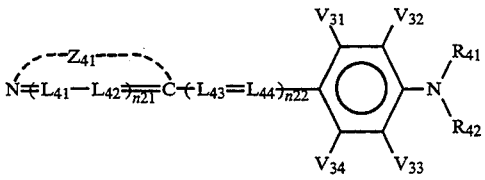

In Formula (VI), $Z_{41}$ represents a group of atoms required to form a 5- or 6-membered nitrogen-containing heterocyclic ring.

Each of $V_{31}$, $V_{32}$, $V_{33}$, and $V_{34}$ represents a hydrogen atom or a monovalent substituent.

Each of $R_{41}$ and $R_{42}$ represents hydrogen an alkyl group, an aryl group, or a heterocyclic group.

Each of $L_{41}$, $L_{42}$, $L_{43}$, and $L_{44}$ represents a methine group.

Each of $n_{21}$ and $n_{22}$ represents 0 or 1.

Note that the structure represented by Formula (VI) is substituted with at least one $-(Q)_{k2}-(MET)_{k1}$.

The structure of Formula (VI) will be described in more detail below.

Examples of $R_{41}$ and $R_{42}$ are a hydrogen atom, an alkyl group (e.g., methyl, ethyl, propyl, isopropyl, butyl, isobutyl, hexyl, octyl, dodecyl, and octadecyl) having 18 or less carbon atoms, an aryl group (e.g., phenyl, 2-naphthyl, and 1-naphthyl) having 18 or less carbon atoms, and a heterocyclic group (e.g., 2-pyridyl, 2-thiazolyl, and 2-furyl) having 18 or less carbon atoms. These substituents may be further substituted. Examples of the substituent are a carboxy group, a sulfo group, a cyano group, a nitro group, a halogen atom (e.g., a fluorine atom, a chlorine atom, an iodine atom, and a bromine atom), a hydroxy group, an alkoxy group (e.g., methoxy, ethoxy, benzyloxy, and phenethyloxy) having 8 or less carbon atoms, an aryloxy group (e.g., phenoxy) having 15 or less carbon atoms, an acyloxy group (e.g., acetyloxy) having 8 or less carbon atoms, an alkoxycarbonyl group having 8 or less carbon atoms, an acyl group having 8 or less carbon atoms, a sulfamoyl group, a carbamoyl group, an alkanesulfonylaminocarbonyl group (e.g., methanesulfonylaminocarbonyl) having 8 or less carbon atoms, an acylaminosulfonyl group (e.g., acetylaminosulfonyl) having 8 or less carbon atoms, an aryl group (e.g., phenyl, 4-methylphenyl, 4-chlorophenyl, and naphthyl) having 15 or less carbon atoms, and a heterocyclic group (e.g., pyrrolidine-2-one-1-yl, tetrahydrofurfuryl, and 2-morpholino) having 15 or less carbon atoms. These substituents may be further substituted with themselves.

Examples of $Z_{41}$ are identical with those of $Z_{11}$ and $Z_{12}$. $Z_{41}$ is particularly preferably a benzoxazole nucleus, a naphthoxazole nucleus, a benzothiazole nucleus, or a naphthothiazole nucleus.

Examples of $V_{31}$, $V_{32}$, $V_{33}$, and $V_{34}$ are identical with those of $V_1$ to $V_{10}$.

$L_{41}$, $L_{42}$, $L_{43}$, and $L_{44}$ are preferably nonsubstituted alkyl groups having 1 to 18 carbon atoms, preferably 1 to 10 carbon atoms, more preferably 1 to 5 carbon atoms.

A styryl-base structure represented by Formula (VI) is substituted with at least one $-(Q)_{k2}-(MET)_{k1}$.

The position of the substitution can be any of $Z_{41}$, $V_{31}$, $V_{32}$, $V_{33}$, and $V_{34}$, $R_{41}$ and $R_{42}$, and $L_{41}$, $L_{42}$, $L_{43}$, and $L_{44}$. A preferable substitution is to groups represented by $R_{41}$ and $R_{42}$.

In a compound represented by Formula (II), it is preferable that the oxidation potential of ST is baser than the oxidation potential of MET.

The details of a compound represented by Formula (III) will be described below.

Formula (III)

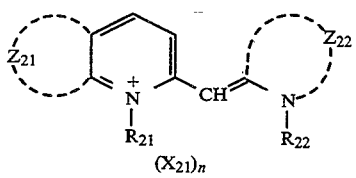

In Formula (III), $R_{21}$ and $R_{22}$ have the same meanings as $R_{11}$ and $R_{12}$ in Formula (I) and are preferably sulfoethyl, sulfopropyl, sulfobutyl, carboxymethyl, or carboxyethyl.

In Formula (III), $Z_{21}$ has the same meaning as $Z_{11}$ in Formula (I), and $X_{21}$ and n have the same meanings as $X_{11}$ and m, respectively, in Formula (I).

$Z_{22}$ represents a group of atoms needed to form a benzoxazole nucleus or a naphthoxazole nucleus, and these atoms may have substituent groups. A preferred example of $Z_{22}$ is a benzoxazole nucleus whose 5-position is substituted with a halogen atom, an alkyl group having 1 to 8 carbon atoms, preferably 1 to 5 carbon atoms, more preferably 1 to 3 carbon atoms, an alkoxy group having 1 to 8 carbon atoms, preferably 1 to 5 carbon atoms, more preferably 1 to 3 carbon atoms, an alkylthio group having 1 to 8 carbon atoms, preferably 1 to 5 carbon atoms, more preferably 1 to 3 carbon atoms, or an aryl group having 6 to 20 carbon atoms, preferably 6 to 15 carbon atoms, more preferably 6 to 10 carbon atoms. Examples of the halogen atom by which the benzoxazole nucleus is substituted are a fluorine atom, a chlorine atom, a bromine atom, and an iodine atom. The halogen atom is preferably a bromine atom or a chlorine atom.

The alkyl group may have a substituent. Examples of the alkyl group are methyl, ethyl, n-propyl, isopropyl, t-butyl, n-butyl, n-octyl, n-decyl, n-hexadecyl, cyclopentyl, cyclohexyl, trifluoromethyl, and hydroxyethyl. The alkyl group is preferably trifluoromethyl.

The alkoxy group is, e.g., methoxy, ethoxy, propoxy, or methylenedioxy, and preferably methoxy.

The alkylthio group is, e.g., methylthio, ethylthio, or propylthio, and preferably methylthio.

The aryl group represents, e.g., phenyl, pentafluorophenyl, 4-chlorophenyl, 3-sulfophenyl, or 4-methylphenyl, and preferably phenyl.

Practical examples of monomethinecyanine dyes represented by Formulas (I), (IV), (V), and (III) for use in the present invention are presented below, but the dyes are not restricted to these examples.

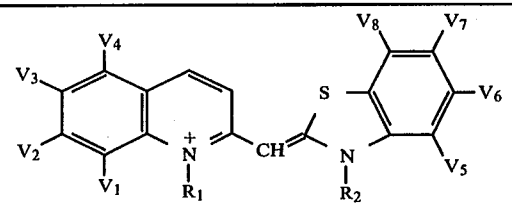

| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| I-1 | H | H | H | H | H | H | H | H | $C_2H_5$ | $C_2H_5$ | $I^-$ |
| I-2 | H | H | H | H | H | Cl | H | H | $C_2H_5$ | $-(CH_2)_4SO_3-$ | — |
| I-3 | H | H | $CH_3$ | H | H | Cl | H | H | $-(CH_2)_4SO_3-$ | $-(CH_2)_4SO_3-$ | $\overset{+}{N}H(C_2H_5)_3$ |
| I-4 | H | H | $C_2H_5$ | H | H | 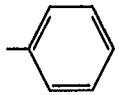 | H | H | $-CH_2COOH$ | $-(CH_2)_2SO_3-$ | — |
| I-5 | H | H | H | H | H | $CH_3$ | H | H | $-(CH_2)_3SO_3-$ | $-CH_2CH_2\underset{\underset{CH_3}{\vert}}{C}HSO_3^-$ | $K^+$ |
| I-6 | H | H | $-N(CH_3)_2$ | H | H | Cl | $CH_3$ | H | $nC_5H_{11}$ | $-(CH_2)_4SO_3-$ | — |
| I-7 | H | H | Cl | H | $OCH_3$ | H | H | H | $-(CH_2)_2SO_3-$ | $-(CH_2)_2SO_3-$ | $\overset{+}{N}H(C_2H_5)_3$ |
| I-8 | H | $CH_3$ | $CH_3$ | H | H | Cl | H | H | $-(CH_2)_4SO_3-$ | $-(CH_2)_4SO_3-$ | 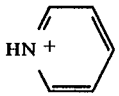 |
| I-9 | H | Cl | $CH_3$ | H | H | H | H | $OCH_3$ | $-(CH_2)_2SCH_3$ | $-(CH_2)_3SO_3-$ | — |
| I-10 | H | $CH_3$ | H | $CH_3$ | H | Cl | H | H | $-CH_2NHCOSO_2CH_3$ | $-(CH_2)_4SO_3-$ | — |
| I-11 | $CH_3$ | H | $CH_3$ | H | H | $SCH_3$ | $SCH_3$ | H | 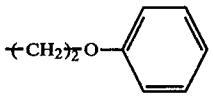 | 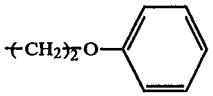 | $I^-$ |
| I-12 | H | H | $SCH_3$ | H | H | $OCH_3$ | $OCH_3$ | H | $-(CH_2)_4SO_3-$ | $-(CH_2)_4SO_3-$ | $Li^+$ |
| I-13 | H | $SCH_3$ | $SCH_3$ | H | H | $OCH_3$ | H | H | $-(CH_2)_2COOH$ | $-(CH_2)_4SO_3-$ | — |

-continued
| | | | | | | | | | | | |
|---|---|---|---|---|---|---|---|---|---|---|---|
| I-14 | H | H | H | H | H | Cl | H | H | $\leftarrow CH_2 \rightarrow_4 SO_3-$ | $\leftarrow CH_2 \rightarrow_4 SO_3-$ | $Na^+$ |
| I-15 | H | H | H | H | H | 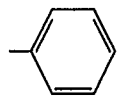 | H | H | $\leftarrow CH_2 \rightarrow_4 SO_3-$ | $\leftarrow CH_2 \rightarrow_4 SO_3-$ | $Na^+$ |
I-16
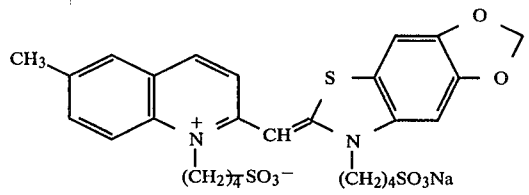
I-17
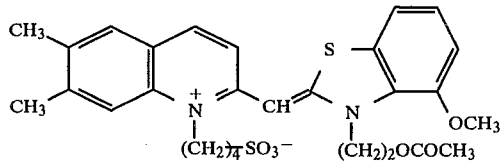
I-18
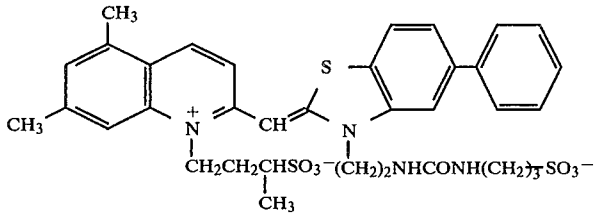
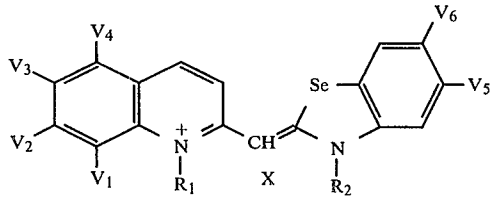
| No. | $V_1$ | $V_2$ | $V_3$ | $V_4$ | $V_5$ | $V_6$ | $R_1$ | $R_2$ | X |
|---|---|---|---|---|---|---|---|---|---|
| I-19 | H | H | H | H | H | H | $C_2H_5$ | $C_2H_5$ | $Br^-$ |
| I-20 | H | H | $CH_3$ | H | Cl | H | $\leftarrow CH_2 \rightarrow_4 SO_3-$ | $\leftarrow CH_2 \rightarrow_4 SO_3-$ | $Na^+$ |

-continued

| | | | | | | | | | |
|---|---|---|---|---|---|---|---|---|---|
| I-21 | H | $CH_3$ | $CH_3$ | H | Cl | $CH_3$ | $-CH_2CH_2\underset{\underset{CH_3}{\vert}}{C}HSO_3^-$ | $C_2H_5$ | — |
| I-22 | $CH_3$ | H | $CH_3$ | H | 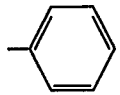 | H | $-(CH_2)_2CONHSO_2CH_3$ | $-(CH_2)_4SO_3-$ | — |
| I-23 | H | $CH_3$ | H | $CH_3$ | Br | H | $-(CH_2)_2SO_3-$ | $-(CH_2)_2SO_3-$ | $\overset{+}{H}N(C_2H_5)_3$ |
| I-24 | H | H | $C_2H_5$ | H | H | $OCH_3$ | $-(CH_2)_2OH$ | $-(CH_2)_2OH$ | $Br^-$ |
| I-25 | H | H | Cl | H | H | $CH_3$ | $-(CH_2)_3SO_3-$ | $-(CH_2)_2COOH$ | — |

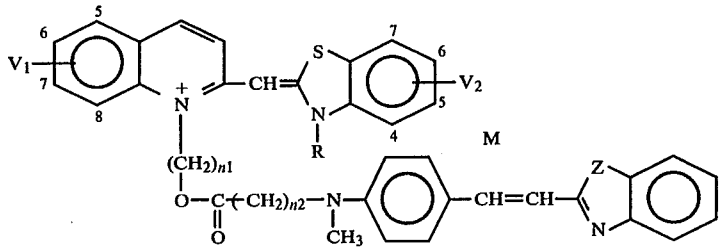

| Compound | $V_1$ | $V_2$ | R | $n_1$ | $n_2$ | Z | M |
|---|---|---|---|---|---|---|---|
| (IV-1) | 6-$CH_3$ | 5-Cl | $C_2H_5$ | 2 | 3 | S | $I^-$ |
| (IV-2) | H | 5-Cl | $C_2H_5$ | 2 | 3 | S | $Br^-$ |
| (IV-3) | H | 5-Cl | $C_2H_5$ | 2 | 5 | S | $Br^-$ |
| (IV-4) | H | 5-Cl | $C_2H_5$ | 2 | 3 | O | $Br^-$ |
| (IV-5) | H | 5-Br | $C_2H_5$ | 2 | 3 | Se | $Br^-$ |
| (IV-6) | H | 5-Cl | $C_2H_5$ | 4 | 3 | S | $Br^-$ |
| (IV-7) | H | 5-Cl | $(CH_2)_4SO_3^-$ | 2 | 3 | S | — |
| (IV-8) | 6-$OCH_3$ | 5-$OCH_3$ | $C_2H_5$ | 2 | 3 | S | $Br^-$ |
| (IV-9) | 6,7-$(CH_3)_2$ | 5-$CF_3$ | $(CH_2)_3SO_3^-$ | 2 | 5 | O | — |
| (IV-10) | 6-$CH_3$ | 5-Ph | $CH_3$ | 2 | 1 | S | $I^-$ |

(IV-11)

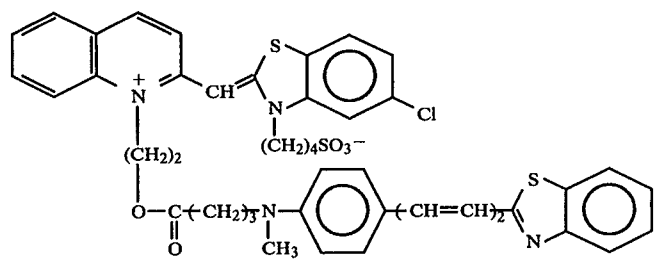

-continued
(IV-12)
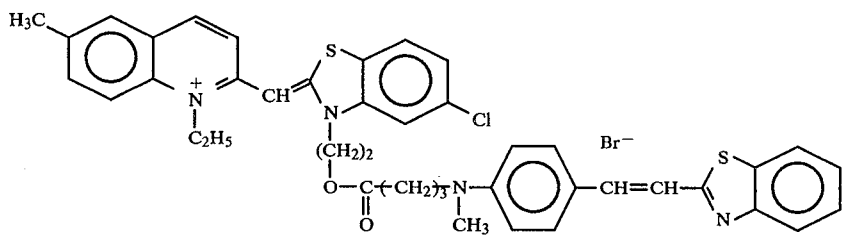
(IV-13)
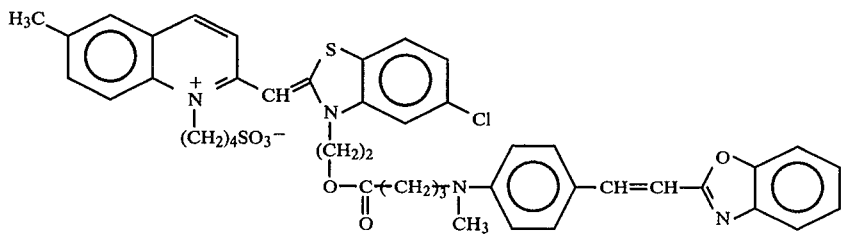
(IV-14)
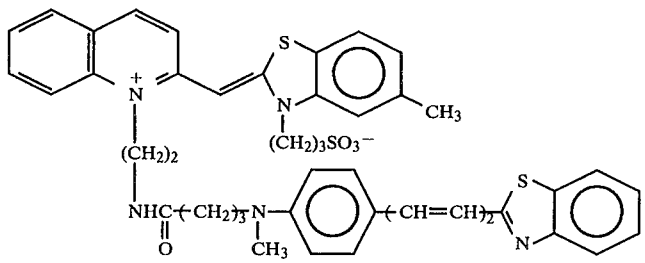
(IV-15)
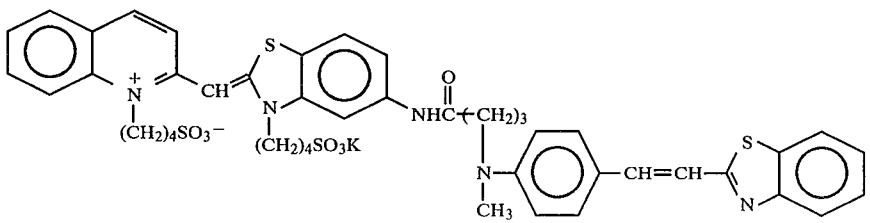

-continued
(IV-16)
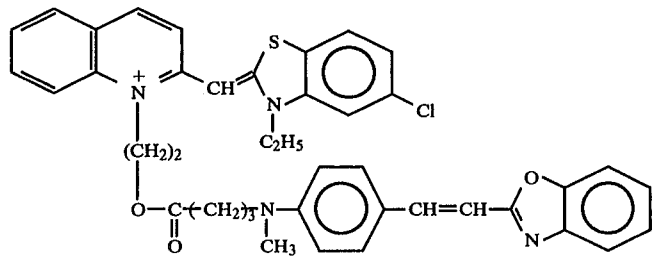
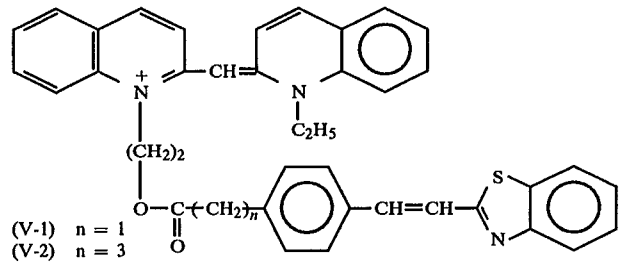
(V-1) n = 1
(V-2) n = 3
(V-3) n = 5
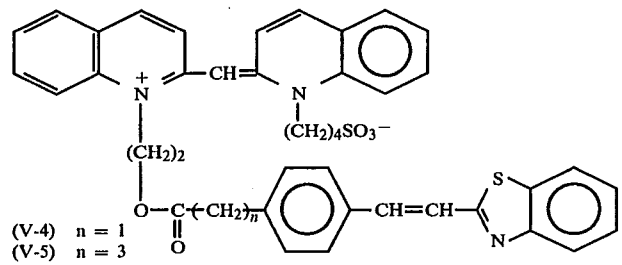
(V-4) n = 1
(V-5) n = 3
(V-6) n = 5

-continued
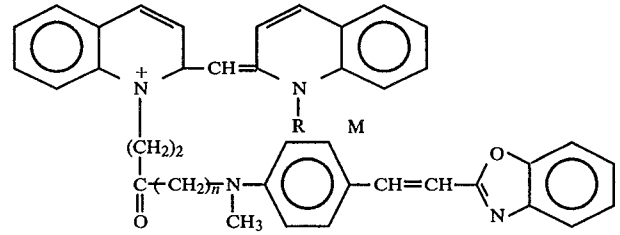
(V-7) n = 3 R = $C_2H_5$ M = $I^-$
(V-8) n = 5 R = $-(CH_2)_4SO_3^-$ M = —
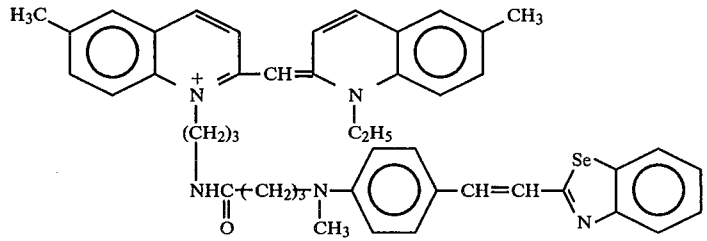
(V-10)
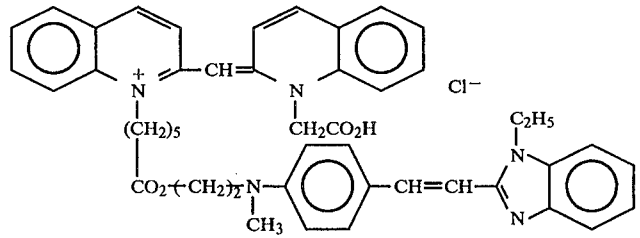
(V-11)
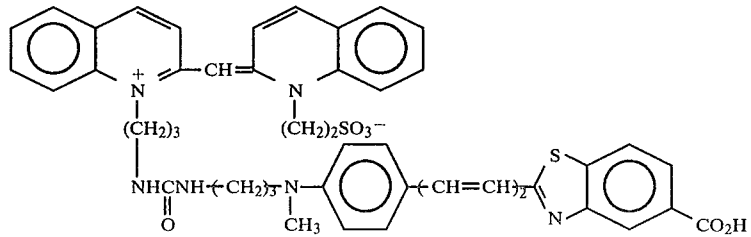

-continued
(V-12)
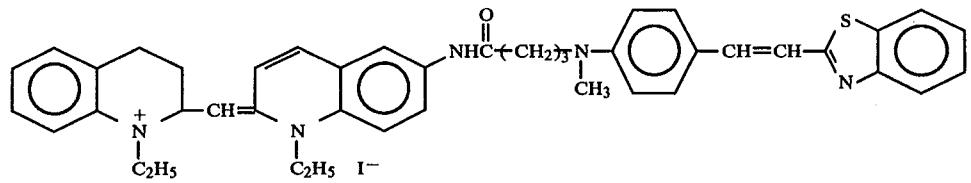
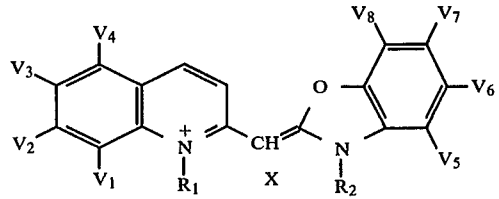
| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| III-1 | H | H | H | H | H | Cl | H | H | $C_2H_5$ | $C_2H_5$ | $I^-$ |
| III-2 | H | H | H | H | H | Cl | H | H | $-(CH_2)_4SO_3-$ | $-(CH_2)_4SO_3-$ | $Na^+$ |
| III-3 | H | H | H | H | H | Cl | $CH_3$ | H | $-(CH_2)_3SO_3-$ | $-(CH_2)_3SO_3-$ | 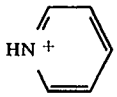 |
| III-4 | H | H | H | H | H | 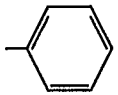 | H | H | $-(CH_2)_2SO_3-$ | $-(CH_2)_2SO_3-$ | $K^+$ |
| III-5 | H | H | $CH_3$ | H | H | 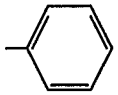 | H | H | $C_2H_5$ | $-(CH_2)_4SO_3-$ | — |
| III-6 | H | H | $CH_3$ | H | H | Br | H | H | $-(CH_2)_3SO_3-$ | $-(CH_2)_3SO_3-$ | $Na^+$ |
| III-7 | H | H | $C_2H_5$ | H | H | $^t$Am | H | H | $CH_2COOH$ | $-(CH_2)_4SO_3-$ | — |
| III-8 | H | H | 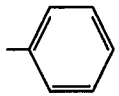 | H | Cl | H | H | H | $C_3H_7$ | $-CH_2CH_2\overset{CH_3}{\overset{\vert}{C}}HSO_3^-$ | — |

-continued

| | | | | | | | | | | | |
|---|---|---|---|---|---|---|---|---|---|---|---|
| III-9 | H | H | 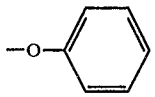 | H | H | H | Cl | H | $CH_3$ | $CH_3$ | 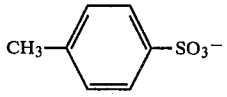 |
| III-10 | $CH_3$ | H | H | H | H | H | H | Cl | $C_2H_5$ | $-(CH_2)_4SO_3-$ | — |
| III-11 | H | $CH_3$ | H | H | H | 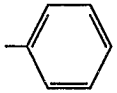 | $CH_3$ | H | $-(CH_2)_4SO_3-$ | $-(CH_2)_3SO_3-$ | $\overset{+}{N}H(C_2H_5)_3$ |
| III-12 | H | H | H | $CH_3$ | H | $OCH_3$ | H | H | $-(CH_2)_2COOH$ | $-(CH_2)_3SO_3-$ | — |
| III-13 | H | $CH_3$ | H | $CH_3$ | H | 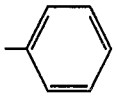 | H | H | $-(CH_2)_4SO_3-$ | $-(CH_2)_4SO_3-$ | $K^+$ |
| III-14 | H | H | Cl | H | H | Br | H | H | $-(CH_2)_4SO_3-$ | $-(CH_2)_4SO_3-$ | $H^+$ |
| III-15 | H | H | $-N(C_2H_5)_2$ | H | H | F | H | H | $CH_3$ | $CH_3$ | $I^-$ |
| III-16 | H | H | $CH_3$ | H | H | 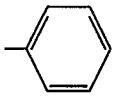 | H | H | $-(CH_2)_4SO_3-$ | $-(CH_2)_4SO_3-$ | $Na^+$ |

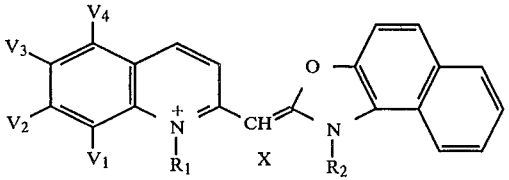

| No. | $V_1$ | $V_2$ | $V_3$ | $V_4$ | $R_1$ | $R_2$ | X |
|---|---|---|---|---|---|---|---|
| III-17 | H | H | H | H | $C_2H_5$ | $C_2H_5$ | $I^-$ |
| III-18 | H | H | H | H | $C_2H_5$ | $-(CH_2)_3SO_3-$ | — |
| III-19 | H | H | $CH_3$ | H | $-(CH_2)_4SO_3-$ | $-(CH_2)_3SO_3-$ | $Na^+$ |
| III-20 | H | $CH_3$ | $CH_3$ | H | $-(CH_2)_4SO_3-$ | $-(CH_2)_2OSO_3-$ | $Na^+$ |

-continued

| | | | | | | | |
|---|---|---|---|---|---|---|---|
| III-21 | H | H | 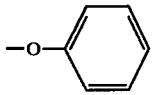 | H | $\leftarrow CH_2 \rightarrow_3 SO_3-$ | $CH_3$ | — |
| III-22 | H | $CH_3$ | H | $CH_3$ | $\leftarrow CH_2 \rightarrow_2 SO_3-$ | $\leftarrow CH_2 \rightarrow_3 SO_3-$ | $\overset{+}{H}N(C_2H_5)_3$ |
| III-23 | H | $C_2H_5$ | H | H | $CH_3$ | $CH_3$ | $I^-$ |
| III-24 | H | H | Cl | H | $iC_3H_7$ | $C_2H_5$ | $Br^-$ |

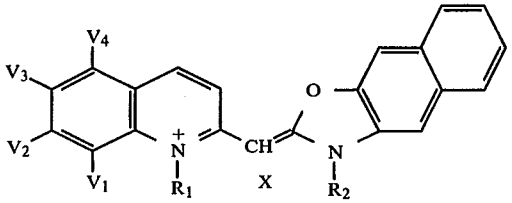

| No. | $V_1$ | $V_2$ | $V_3$ | $V_4$ | $R_1$ | $R_2$ | X |
|---|---|---|---|---|---|---|---|
| III-25 | H | H | H | H | $CH_3$ | $CH_3$ | $I^-$ |
| III-26 | H | H | $CH_3$ | H | $\leftarrow CH_2 \rightarrow_4 SO_3-$ | $\leftarrow CH_2 \rightarrow_4 SO_3-$ | $Na^+$ |
| III-27 | H | $CH_3$ | H | H | $\leftarrow CH_2 \rightarrow_2 SO_3-$ | $\leftarrow CH_2 \rightarrow_3 SO_3-$ | $\overset{+}{H}N(C_2H_5)_3$ |
| III-28 | H | $CH_3$ | H | $CH_3$ | $\leftarrow CH_2 \rightarrow_2 SOOH$ | $\leftarrow CH_2 \rightarrow_2 OSO_3-$ | — |
| III-29 | H | H | 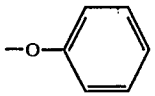 | H | $\leftarrow CH_2 \rightarrow_2 OSO_3-$ | $\leftarrow CH_2 \rightarrow_2 SO_3-$ | $Li^+$ |
| III-30 | H | H | Cl | H | $C_2H_5$ | $\leftarrow CH_2 \rightarrow_4 SO_3-$ | — |

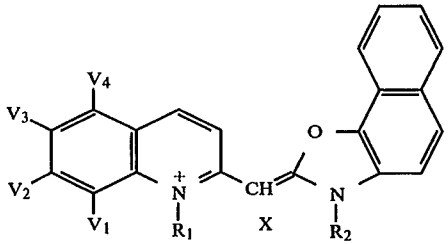

-continued
| No. | $V_1$ | $V_2$ | $V_3$ | $V_4$ | $R_1$ | $R_2$ | X |
|---|---|---|---|---|---|---|---|
| III-31 | H | H | H | H | $-(CH_2)_4SO_3-$ | $-(CH_2)_4SO_3-$ | $K^-$ |
| III-32 | H | H | $CH_3$ | H | $-(CH_2)_4SO_3-$ | $-(CH_2)_2SO_3-$ | 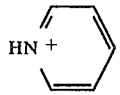 |
| III-33 | H | $CH_3$ | H | H | $CH_3$ | $C_2H_5$ | $I^-$ |
| III-34 | H | $CH_3$ | H | $CH_3$ | $nC_5H_{11}$ | $-(CH_2)_3SO_3-$ | — |
| III-35 | H | H | Cl | H | $-(CH_2)_4SO_3-$ | $-(CH_2)_4SO_3-$ | $Na^+$ |

Compounds represented by Formulas (I), (II), and (III) of the present invention can be synthesized on the basis of the methods described in, e.g., F. M. Hamer, "Heterocyclic Compounds—Cyanine Dyes and Related Compounds," John Wiley & Sons, New York, London, 1964; D. M. Sturmer, "Heterocyclic Compounds—Special topics in heterocyclic chemistry—," Chapter 18, Paragraph 14, pages 482 to 515, John Wiley & Sons, New York, London, 1977; and "Rodd's Chemistry of Carbon Compounds," 2nd ed., Vol. IV, part B, 1977, Chapter 15, pages 369 to 422, and 2nd ed., Vol. IV, part B, 1985, chapter 15, pages 267 to 296, Elsevier Science Publishing Company Inc., New York.

The addition amount of a compound represented by Formula (II) of the present invention is preferably 0.1 to 10 mol %, and more preferably 0.5 to 5 mol % with respect to a compound represented by Formula (I).

A compound represented by Formula (II) of the present invention can be added either simultaneously with or separately from the addition of the compounds represented by Formulas (I) and (III). In the case of the separate addition, the compound of Formula (II) may be added before the start of chemical sensitization, during chemical sensitization, or after chemical sensitization.

The addition amount of compounds represented by Formulas (I) and (III) widely varies in accordance with the intended use. The addition amount ranges preferably between $0.5\times10^{-6}$ mol and $1.0\times10^{-2}$ mol per mol of silver halides used, and more preferably between $1.0\times10^{-6}$ mol and $5.0\times10^{-3}$ mol per mol of silver halides used. If compounds represented by Formulas (I) and (III) are to be used together, they can be either added by mixing or added separately in order to obtain a desired spectral sensitivity. The addition of the compounds of Formula (I) and (III) can be anywhere from during grain formation of a silver halide to immediately before coating. It is, however, preferable to add the compounds after desalting and before the end of chemical sensitization. The compounds are more preferably added after desalting and before the start of chemical sensitization.

To allow spectral sensitizing dyes represented by Formulas (I), (II), and (III) to be contained in silver halide emulsions, they can be dispersed directly in the emulsions. Alternatively, these spectral sensitizing dyes can be dissolved in one or a mixture of solvents, such as water, methanol, ethanol, propanol, methylcellosolve, 2,2,3,3-tetrafluoropropanol, and added in the solution form. It is also possible to prepare an aqueous solution of the dyes in the presence of an acid or a base and add the resultant solution to an emulsion, as described in JP-B-44-23389, JP-B-44-27555, and JP-B-57-22089, or to prepare an aqueous solution or a colloid dispersion of the dyes in the presence of a surfactant and add the solution or the dispersion to an emulsion, as described in U.S. Pat. Nos. 3,822,135 and 4,006,025. In addition, it is possible to dissolve the dyes in a solvent, such as phenoxyethyl alcohol, which is essentially immiscible with water, disperse the solution in water or a hydrophilic colloid, and add the dispersion to an emulsion. Furthermore, as described in JP-A-53-102733 and JP-A-58-105141,it is possible to disperse the dyes directly in a hydrophilic colloid and add the resultant dispersion to an emulsion. An addition of the dyes to an emulsion can be any time during the preparation of an emulsion, which is conventionally known to be useful. That is, the dyes can be added before grain formation of a silver halide, during grain formation, from immediately after grain formation to before washing, before chemical sensitization, during chemical sensitization, from immediately after chemical sensitization to before setting of an emulsion by cooling, or during preparation of a coating solution.

As described in U.S. Pat. Nos. 3,628,969 and 4,225,666, the dyes can be added simultaneously with chemical sensitizers to perform spectral sensitization and chemical sensitization at the same time. Also, spectral sensitization can be performed prior to chemical sensitization as described in JP-A-58-113928, or started by adding the dyes before the completion of precipitation formation of silver halide grains. Furthermore, the spectral sensitizing dyes can be separately added as disclosed in U.S. Pat. No. 4,225,666. That is, it is possible to add a portion of the dyes prior to chemical sensitization and the rest of the dyes after the chemical sensitization. As discussed above, the dyes can be added at any time during grain formation of a silver halide, including the method disclosed in U.S. Pat. No. 4,183,756. Of these addition timings, the sensitizing dyes are preferably added before washing of an emulsion or before chemical sensitization.

To obtain the interimage effect as mentioned earlier in a specific wavelength region, it is preferable to form an interimage effect donor layer which is separately provided and contains silver halide grains spectrally sensitized to a predetermined degree. To realize the spectral sensitivity of the present invention, the weight-averaged wavelength of this interimage effect donor layer is set between 510 and 540 nm by using the sensitizing dyes of the present invention.

As a material for giving rise to the interimage effect, a compound which releases a development inhibitor or its precursor by reacting with the oxidized form of a developing agent, which is prepared by development, is used. Examples of the compound are a DIR (development inhibitor releasing) coupler, DIR-hydroquinone, and a coupler which releases DIR-hydroquinone or its precursor. For a development inhibitor having a high diffusivity, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as that of a layer which undergoes the influence of the undesired development inhibiting effect). Color generation of magenta is preferable to obtain the spectral sensitivity of the present invention.

The size and the shape of silver halide grains to be used in the layer having the interimage effect on red-sensitive layers are not particularly restricted. It is, however, favorable to use so-called tabular grains having a high aspect ratio, a monodisperse emulsion which is uniform in grain size, or silver iodobromide grains having a layered structure of iodide. In addition, to enlarge the exposure latitude, it is preferable to mix two or more types of emulsions of differing grain size.

Although the layer having the interimage effect on red-sensitive layers can be coated at any position on a support, it is preferable to coat this layer closer to the support than blue-sensitive layers and farther from the support than green-sensitive layers. It is more preferable that the layer be located closer to the support than a yellow filter layer.

The layer having the interimage effect on red-sensitive layers may consist of a plurality of layers. In that case, these layers may be either adjacent to or separated away from each other.

The yellow filter layer preferably contains colloid silver and/or yellow dyestuff, and more preferably contains yellow dyestuff described in JP-A-3-167546.

Silver halide photographic emulsions which can be used in the light-sensitive material of the present invention can be prepared by methods described in, for example, Research Disclosure (RD) No. 17643 (December, 1978), pages 22 and 23, "I. Emulsion preparation and types", RD No. 18716 (November, 1979), page 648, and RD No. 307105 (November, 1989), pages 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

In the present invention, it is particular preferable that tabular grains having an aspect ratio of 2 or more be used at a ratio of 40% or more of the total projected area of silver halide grains contained in the layer for giving rise to the interimage effect.

An aspect ratio means the ratio of the diameter of a silver halide grain to the thickness of that grain. That is, an aspect ratio is the value obtained by dividing the diameter of each individual silver halide grain by its thickness. Assume that a "diameter" herein mentioned means the diameter of a circle having an area equal to the projected area of a grain when a silver halide emulsion is observed with a microscope or an electron microscope. Therefore, an aspect ratio of 2 or more means that the diameter of this circle is twice or more the thickness of a grain.

The grain size of tabular silver halide grains for use in silver halide emulsions of the present invention is preferably twice or more, more preferably 3 to 15 times, and most preferably 4 to 10 times the grain thickness. The ratio of tabular silver halide grains in the projected area of all silver halide grains is preferably 40% or more, more preferably 70% or more, and most preferably 85% or more.

Silver halide emulsions consisting of tabular grains are described in the report by Cugnac and Chateau; Duffin, "Photographic Emulsion Chemistry," Focal Press, New York, 1966, pages 66 to 72, and A. P. H. Trivelli and W. F. Smith ed., "Photo. Journal," 80 (1940), page 285. These tabular silver halide emulsions can be prepared easily in accordance with methods described in, e.g., JP-A-58-113927, JP-A-58-113928, and JP-A-58-127921.

A crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be any of a surface latent image type emulsion which mainly forms a latent image on the surface of a grain, an internal latent image type emulsion which forms a latent image in the interior of a grain, land an emulsion of another type which has latent images on the surface and in the interior of a grain. However, the emulsion must be a negative type emulsion. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in Research Disclosure Nos. 17643, 18716, and 307105. The corresponding portions are summarized in a table presented below.

| Types of additives | RD17643 [Dec.1978] | RD18716 [Nov.1979] | RD307105 [Nov.1989] |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Antifoggants, stabilizers | pages 24–25 | page 649, right column | pages 868–870 |
| 6. Light absorbents, filter dyes, ultra violet absorbents | pages 25–26 | page 649, right column to page 650, left column | page 873 |
| 7. Stain preventing agents | page 25, right column | page 650, left to right columns | page 872 |
| 8. Dye image stabilizers | page 25 | page 650, left column | page 872 |
| 9. Film hardeners | page 26 | page 651, left column | pages 874–875 |
| 10. Binders | page 26 | page 651, left column | pages 873–874 |
| 11. Plasticizers, lubricants | page 27 | page 650, right column | page 876 |
| 12. Coating aids, surfactants | pages 26–27 | page 650, right column | pages 875–876 |
| 13. Antistatic agents | page 27 | page 650, right column | pages 876–877 |
| 14. Matting agents | | | pages 878–879 |

Other techinques and inorganic and organic material which can be applied to the color photographic light-sensitive material of the present invention are described in portions of EP436,938A2 and patents cited below.

1. Layer arrangement: page 146, line 34 to page 147, line 25
2. Yellow coupler: page 137, line 35 to page 146, line 33, and page 149, lines 21 to 23
3. Magenta coupler: page 149, lines 24 to 28; EP421,4-53A1, page 3, line 5 to page 25, line 55
4. Cyan coupler: page 149, lines 29 to 33; EP432,804A2, page 3, line 28 to page 40, line 2
5. Polymer coupler: page 149, lines 34 to 38; EP435,3-34A2, page 113, line 39 to page 123, line 37
6. Colored coupler: page 53, line 42 to page 137, line 34, and page 149, lines 39 to 45

7. Other functional couplers: page 7, line 1 to page 53, line 41, and page 149, line 46 to page 150, line 3; EP435,334A2, page 3, line 1 to page 29, line 50
8. Antiseptic and mildewproofing agents: page 150, lines 25 to 28
9. Formalin scavenger: page 149, lines 15 to 17
10. Other additives: page 153, lines 38 to 47; EP421,4-53A1, page 75, line 21 to page 84, line 56, and page 27, line 40 to page 37, line 40
11. Dispersion method: page 150, lines 4 to 24
12. Support: page 150, lines 32 to 34
13. Thickness and physical properties of film: page 150, lines 35 to 49
14. Color development process: page 150, line 50 to page 151, line 47
15. Desilvering process: page 151, line 48 to page 152, line 53
16. Automatic developing machine: page 152, line 54 to page 153, line 2
17. Washing/stabilizing process: page 153, lines 3 to 37.

Example 1

<Preparation of emulsions>

(i) 1000 ml of an aqueous solution containing 3 g of gelatin and 3.2 g of KBr was stirred at 60° C. (ii) An aqueous silver nitrate solution (containing 8.2 g of $AgNO_3$) and an aqueous halide solution (containing 5.7 g of KBr) were added by double-jet over 1 minute. (iii) 21.5 g of gelatin were added to the resultant solution, and the solution was heated up to 75° C. (iv) An aqueous silver nitrate solution (containing 136.3 g of $AgNO_3$) and an aqueous halide solution (containing 2.0 mol % of KI with respect to KBr) were added by double-jet over 51 minutes at accelerated flow rates. At that time, the silver potential was kept at 0 mV with respect to the saturated calomel electrode for the first 46 minutes. (v) The temperature was decreased to 40° C., and an aqueous silver nitrate solution (containing 3.2 g of $AgNO_3$) and an aqueous KI solution (containing 3.2 g of KI) were added over 5 minutes. Thereafter, (vi) an aqueous silver nitrate solution (containing 25.4 g of $AgNO_3$) and an aqueous KBr solution were added by double-jet over 5.35 minutes. At this time, the silver potential was kept at −50 mV with respect to the saturated calomel electrode. (vii) The resultant emulsion was desalted by flocculation and added with gelatin. Thereafter, the pH and the pAg were adjusted to 5.5 and 8.7, respectively, and chemical sensitization was optimally performed for the emulsion by using sodium thiosulfate, potassium thiocyanate, chloroauric acid, and di-methylselenourea. It was found that, in the resultant emulsion F, 80% of the total projected area were accounted for by tabular grains with an average equivalent-circle diameter of 0.60 μm, an average thickness of 0.15 μm, an average aspect ratio of 5.2, and an average silver iodide content of 3.5 mol %.

Emulsions A to I were prepared by controlling the gelatin quantity, the pAg, the ripening time, and the temperature of this emulsion.

On an undercoated cellulose triacetate film support, a sample 101 as a multilayered color light-sensitive material consisting of layers having the compositions presented below was prepared.

<Compositions of light-sensitive layers>

The-coating amount of each of a silver halide and colloidal silver is represented by a silver amount in units of g/m², and that of each of a coupler, an additive, and gelatin is represented in units of g/m². The coating amount of a sensitizing dye is represented by the number of mols per mol of the silver halides used in the same layer. Symbols representing additives have the following meanings. Note that an additive having a plurality of effects is represented by one of them.

UV: ultraviolet absorbent, Solv: high-boiling organic solvent, ExF: dye, ExS: sensitizing dye, ExC: cyan coupler, ExM: magenta coupler, ExY: yellow coupler, Cpd: additive.

<Preparation of the sample 101>

| | |
|---|---|
| 1st layer (antihalation layer) | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| 2nd layer (low-speed red-sensitive emulsion layer) | |
| Silver bromoiodide emulsion A silver coated amount | 0.35 |
| Silver bromoiodide emulsion B silver coated amount | 0.18 |
| Gelatin | 0.77 |
| ExS-1 | $6.5 \times 10^{-4}$ |
| ExS-2 | $3.6 \times 10^{-4}$ |
| ExS-5 | $6.2 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-1 | $2.2 \times 10^{-2}$ |
| 3rd layer (medium-speed red-sensitive emulsion layer) | |
| Silver bromoiodide emulsion C silver coated amount | 0.55 |
| Gelatin | 1.46 |
| ExS-1 | $4.3 \times 10^{-4}$ |
| ExS-2 | $2.4 \times 10^{-4}$ |
| ExS-5 | $4.1 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| 4th layer (high-speed red-sensitive emulsion layer) | |
| Silver bromoiodide emulsion D silver coated amount | 1.05 |
| Gelatin | 1.38 |
| ExS-1 | $3.6 \times 10^{-4}$ |
| ExS-2 | $2.0 \times 10^{-4}$ |
| ExS-5 | $3.4 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| 5th layer (intermediate layer) | |

-continued

| | |
|---|---|
| Gelatin | 0.62 |
| Cpd-1 | 0.13 |
| Polyethylacrylate latex | $8.0 \times 10^{-2}$ |
| Solv-1 | $8.0 \times 10^{-2}$ |
| 6th layer (low-speed green-sensitive emulsion layer) | |
| Silver bromoiodide emulsion B silver coated amount | 0.10 |
| Silver bromoiodide emulsion A silver coated amount | 0.28 |
| Gelatin | 0.31 |
| ExS-4 | $12.8 \times 10^{-4}$ |
| ExS-5 | $2.1 \times 10^{-4}$ |
| ExS-8 | $1.2 \times 10^{-4}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th layer (medium-speed green-sensitive emulsion layer) | |
| Silver bromoiodide emulsion C silver coated amount | 0.37 |
| Gelatin | 0.54 |
| ExS-4 | $8.5 \times 10^{-4}$ |
| ExS-5 | $1.4 \times 10^{-4}$ |
| ExS-8 | $8.3 \times 10^{-5}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th layer (high-speed green-sensitive emulsion layer) | |
| Silver bromoiodide emulsion D silver coated amount | 0.53 |
| Gelatin | 0.61 |
| ExS-4 | $7.1 \times 10^{-4}$ |
| ExS-5 | $1.4 \times 10^{-4}$ |
| ExS-8 | $4.6 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th layer (intermediate layer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethylacrylate latex | $5.0 \times 10^{-2}$ |
| Solv-1 | $3.0 \times 10^{-2}$ |
| 10th layer (donor layer having interimage effect on red-sensitive layer) | |
| Silver bromoiodide emulsion E silver coated amount | 0.40 |
| Silver bromoiodide emulsion F silver coated amount | 0.20 |
| Silver bromoiodide emulsion G silver coated amount | 0.39 |
| Gelatin | 0.87 |
| ExS-3 | $9.8 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| 11th layer (yellow filter layer) | |
| Yellow colloidal silver | $4.2 \times 10^{-2}$ |

-continued

| | |
|---|---|
| DYE-1 | $1.02 \times 10^{-1}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th layer (low-speed blue-sensitive emulsion layer) | |
| Silver bromoiodide emulsion A silver coated amount | 0.50 |
| Silver bromoiodide emulsion H silver coated amount | 0.40 |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th layer (intermediate layer) | |
| Gelatin | 0.30 |
| ExY-4 | 0.14 |
| Solv-1 | 0.14 |
| 14th layer (high-speed blue-sensitive emulsion layer) | |
| Silver bromoiodide emulsion I silver coated amount | 0.40 |
| Gelatin | 0.95 |
| ExS-6 | $6.3 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th layer (1st protective layer) | |
| Fine grain silver bromoiodide emulsion J silver coated amount | 0.12 |
| Gelatin | 0.63 |
| UV-4 | 0.11 |
| UV-5 | 0.18 |
| Cpd-3 | 0.10 |
| Solv-1 | $2.0 \times 10^{-2}$ |
| Polyethylacrylate latex | $9.0 \times 10^{-2}$ |
| 16th layer (2nd protective layer) | |
| Fine grain silver bromoiodide emulsion J silver coated amount | 0.36 |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-5 | $2.0 \times 10^{-2}$ |
| H-1 | 0.18 |

In addition to the above components, the sample thus prepared was added with 1,2-benzisothiazoline-3-one (200 ppm on average with respect to gelatin), n-butyl-p-hydroxybenzoate (about 1,000 ppm on average with respect to gelatin), and 2-phenoxyethanol (about 10,000 ppm on average with respect to gelatin). In order to improve the storage stability, processability, resistance to pressure, antiseptic and mildewproofing properties, antistatic properties, and coating properties, the individual layers were further made contain W-1 to W-6, B-1 to B-6, F-1 to F-16, iron salt, lead salt, gold salt, platinum salt, iridium salt, and rhodium salt.

The contents of the emulsions used in the individual layers are presented in Table 1 below.

TABLE 1

| Emulsion No. | Average AgI content (mol %) | Average grain size of equivalent-sphere diameter (μm) | Variation coefficient of grain size distribution (%) | Diameter/thickness ratio | Grain shape |
|---|---|---|---|---|---|
| Emulsion A | 3.0 | 0.28 | 23 | 4.5 | Tabular grain |
| B | 3.0 | 0.35 | 25 | 5.6 | " |

TABLE 1-continued

| Emulsion No. | Average AgI content (mol %) | Average grain size of equivalent-sphere diameter (μm) | Variation coefficient of grain size distribution (%) | Diameter/ thickness ratio | Grain shape |
|---|---|---|---|---|---|
| C | 8.8 | 0.53 | 22 | 5.5 | " |
| D | 8.8 | 0.67 | 26 | 6.0 | " |
| E | 2.5 | 0.28 | 21 | 4.8 | " |
| F | 3.5 | 0.60 | 23 | 5.2 | " |
| G | 3.4 | 0.53 | 25 | 5.8 | " |
| H | 8.8 | 0.62 | 26 | 6.0 | " |
| I | 8.8 | 0.75 | 26 | 6.5 | " |
| J | 2.0 | 0.07 | 15 | 1.0 | Uniform-structure fine grain |

In Table 1, (1) The emulsions A to I were subjected to reduction sensitization during grain preparation by using thiourea dioxide and thiosulfonic acid in accordance with the examples in JP-A-2-191938.

(2) The emulsions A to I were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The preparation of tabular grains was performed by using low-molecular-weight gelatin in accordance with the examples in JP-A-1-158426.

(4) Dislocation lines as described in JP-A-3-237450 were found in tabular grains when observed with a high-voltage electron microscope.

(5) The emulsions A to I were made contain iridium in the interior of their grains by the method described in, e.g., B. H. Carroll, "Photographic Science and Engineering," 24, 265 (1980).

The compounds used in the above layers are shown below.

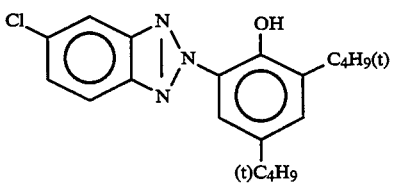

UV-1

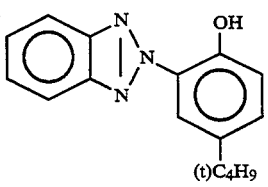

UV-2

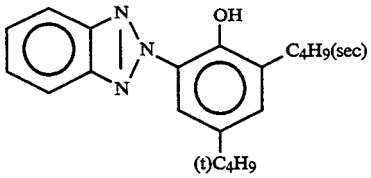

UV-3

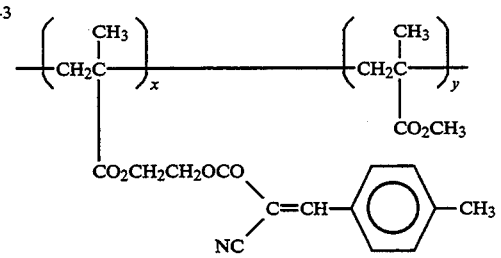

UV-4 x:y = 70:30 (wt%)

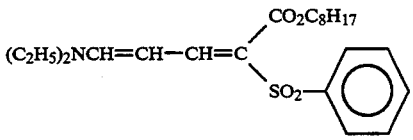

UV-5

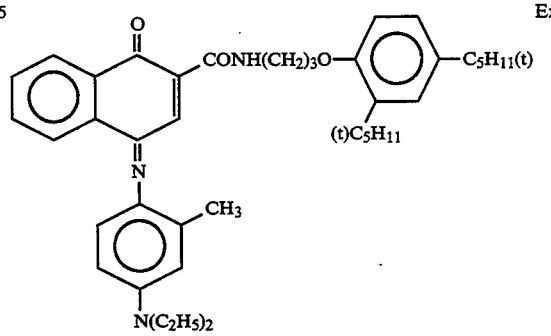

ExF-1

-continued
ExF-2
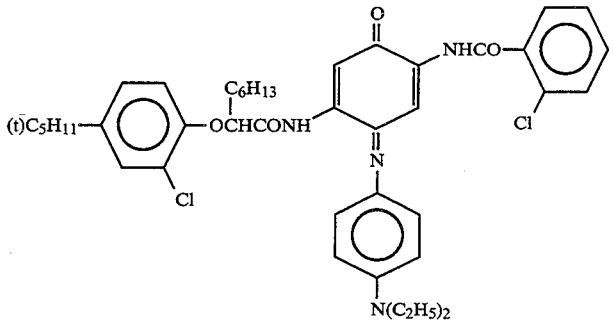
ExF-3
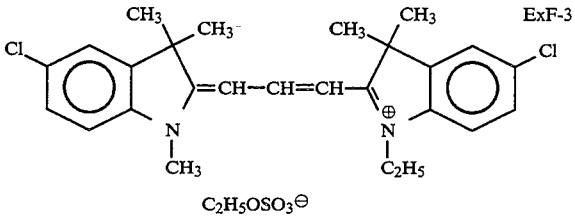
ExC-1
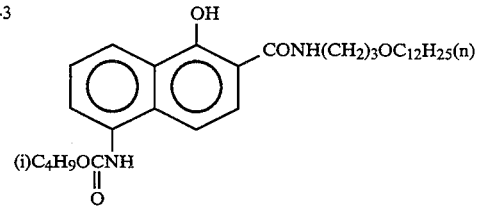
ExC-2
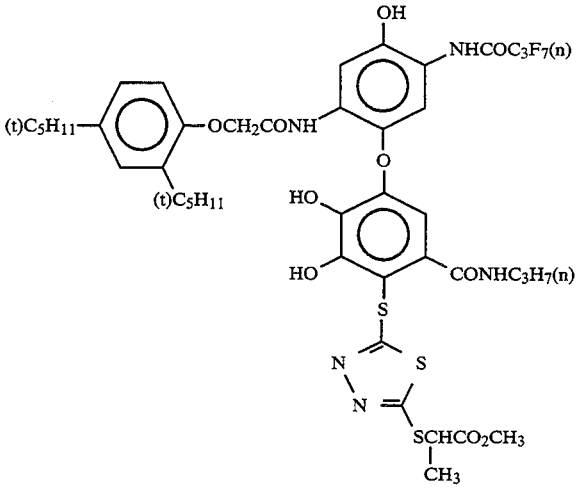
ExC-3
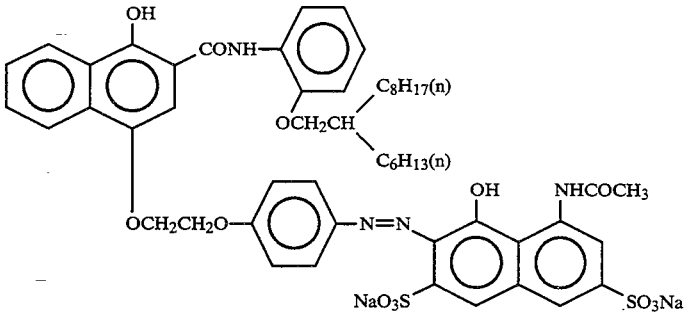
ExC-4
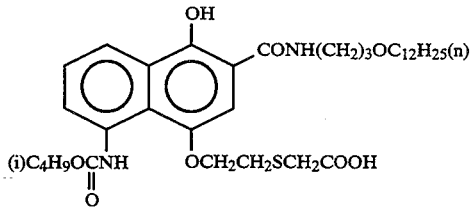

-continued
ExC-5
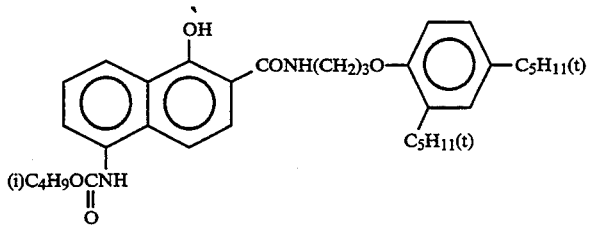
ExC-6
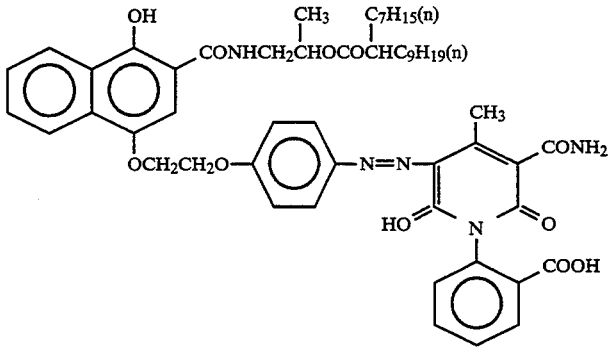
ExC-7
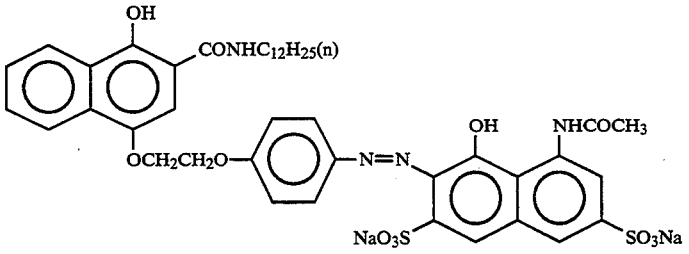
ExC-8
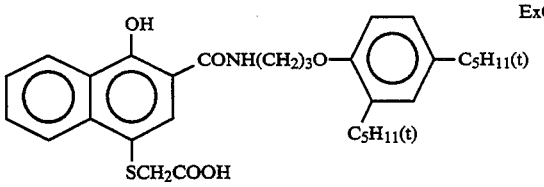
ExC-9
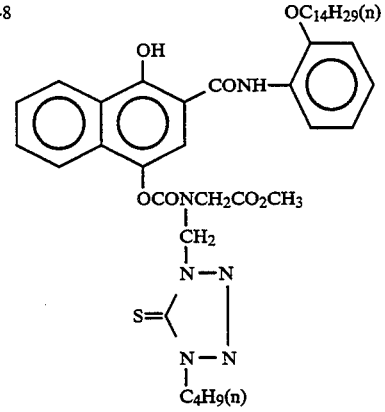
ExM-1
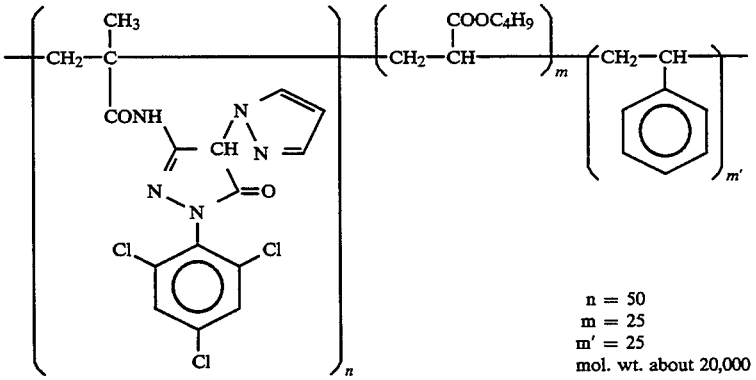
n = 50
m = 25
m' = 25
mol. wt. about 20,000

-continued
ExM-2
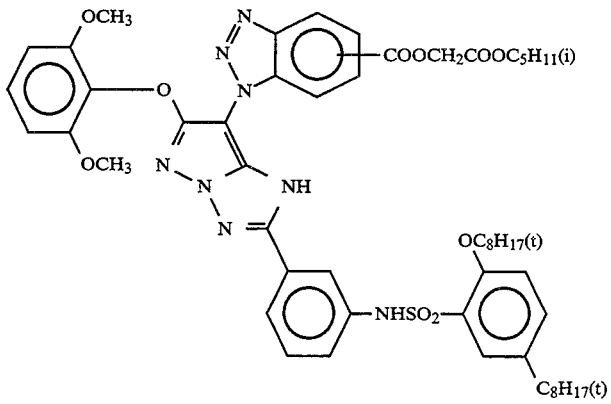
ExM-3
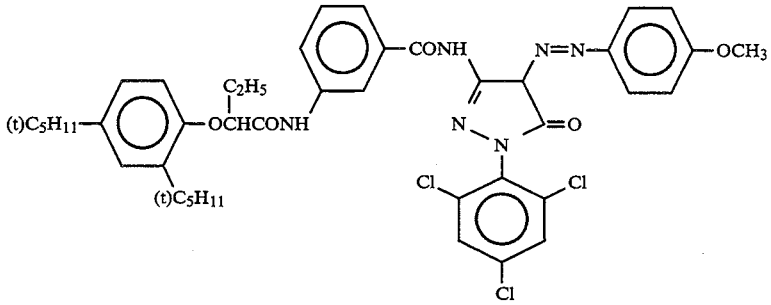
ExM-4
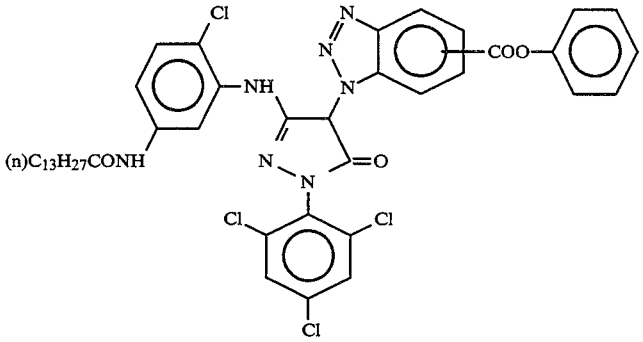
ExM-5
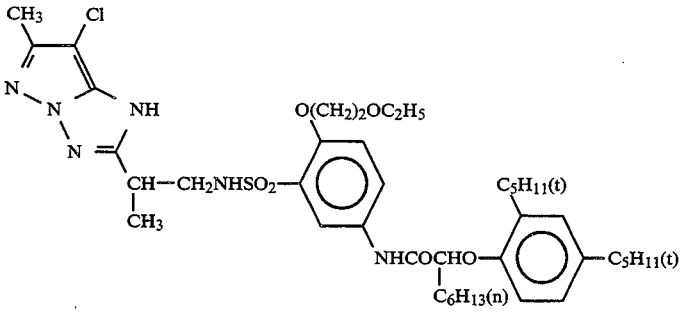

-continued
ExM-6
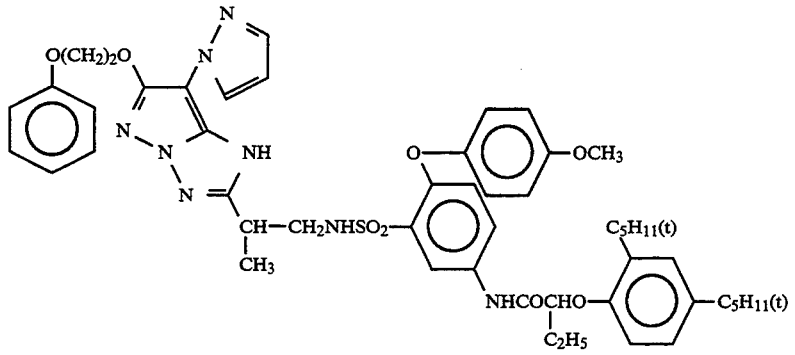
ExM-7
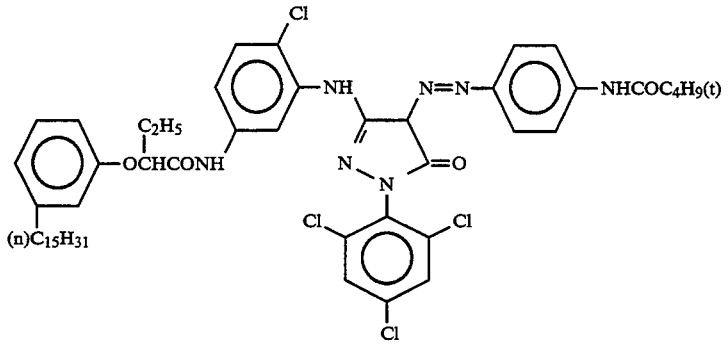
ExY-1
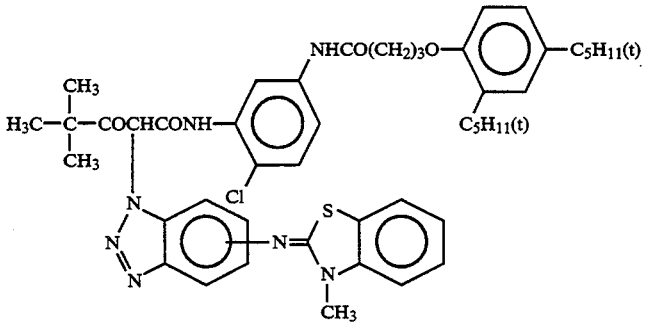
ExY-2
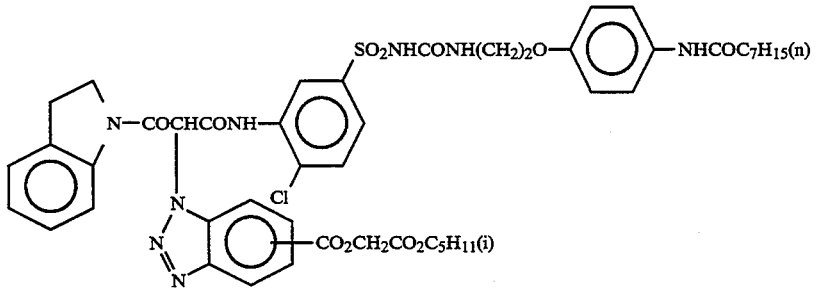
ExY-3
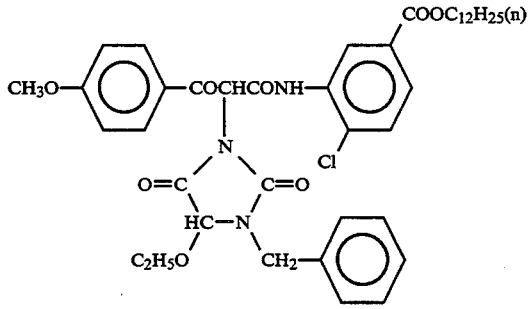

-continued
ExY-4
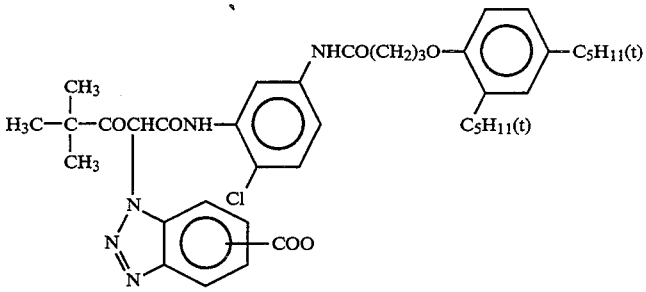
ExY-5
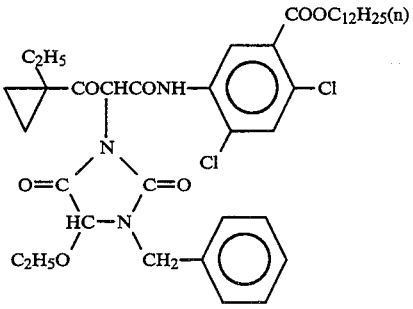
Cpd-1
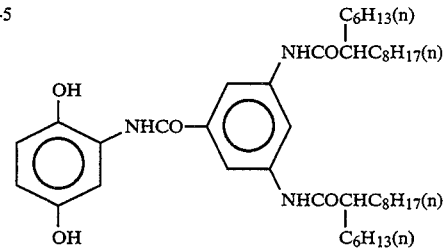
Cpd-2
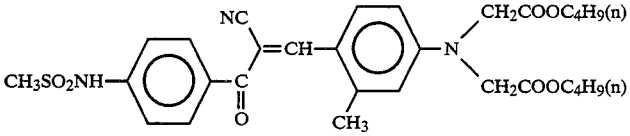
Cpd-3
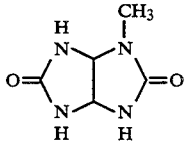
Cpd-4
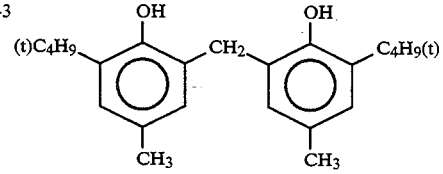
Cpd-5
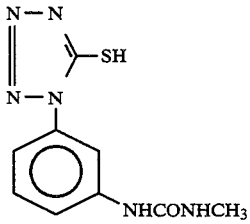
Cpd-6
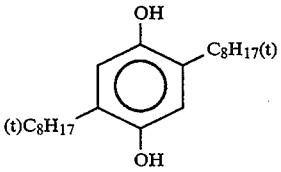
Solv-1
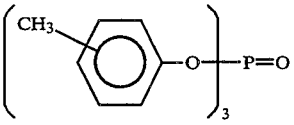
Solv-2
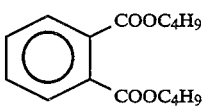
Solv-3
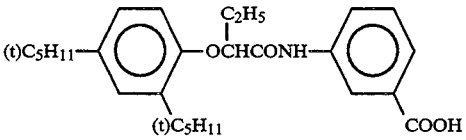
Solv-4
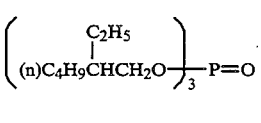
Solv-5
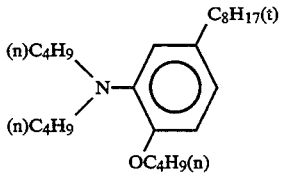
ExS-1
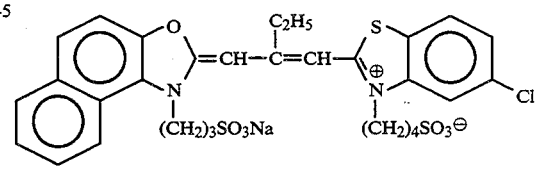

-continued
ExS-2
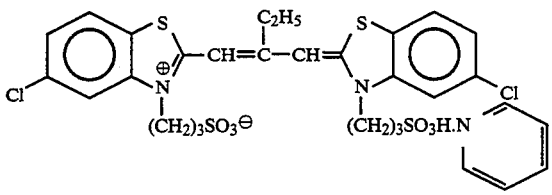
ExS-3
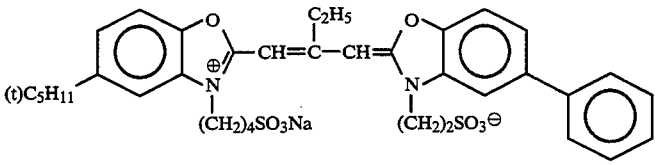
ExS-4
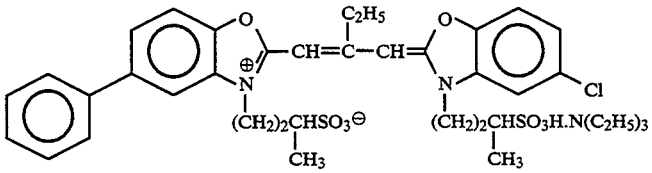
ExS-5
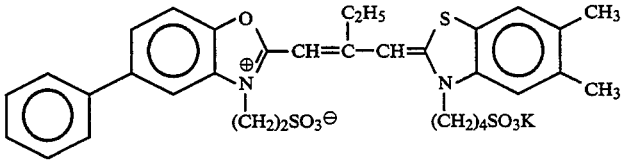
ExS-6
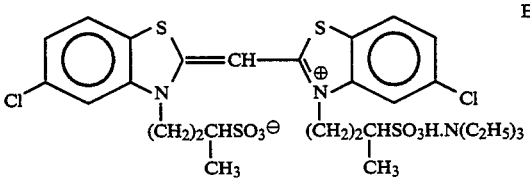
ExS-7
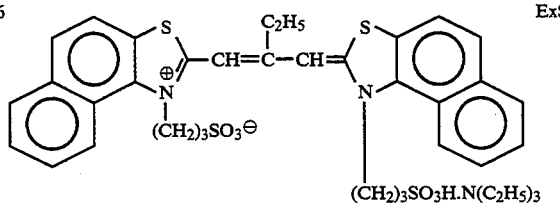
ExS-8
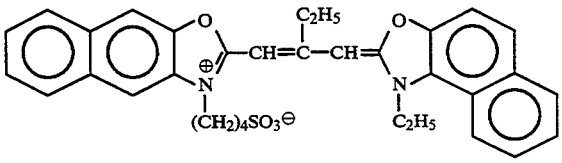
H-1
$CH_2{=}CH{-}SO_2{-}CH_2{-}CONH{-}CH_2$
$CH_2{=}CH{-}SO_2{-}CH_2{-}CONH{-}CH_2$
W-1
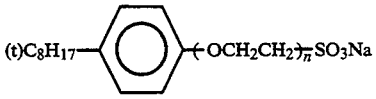
n = 2 to 4
W-2
$C_8F_{17}SO_2NHCH_2CH_2CH_2OCH_2CH_2\overset{\oplus}{N}(CH_3)_3$
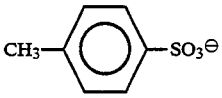
W-3
$(n)C_4H_9CH(C_2H_5)CH_2COOCH_2$
$(n)C_4H_9CH(C_2H_5)CH_2COOCHSO_3Na$
W-4
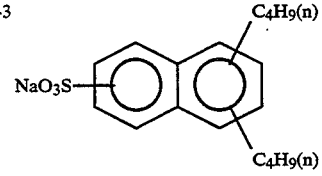
$C_8F_{17}SO_2N(C_3H_7)CH_2COOK$
W-5
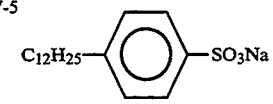
W-6

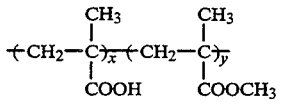
x/y = 10/90
-continued
B-1
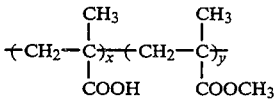
x/y = 40/60
B-2
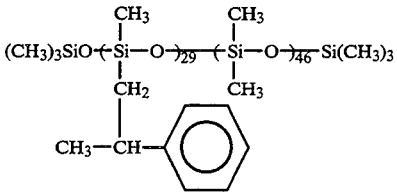
B-3
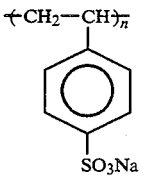
B-4
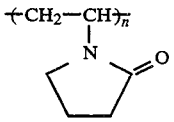
(mol. wt. about 10,000)
B-5
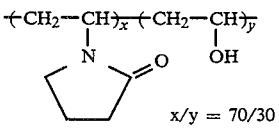
x/y = 70/30
B-6
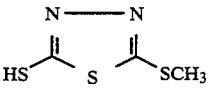
F-1
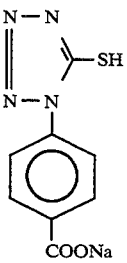
F-2
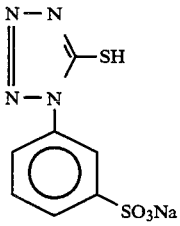
F-3
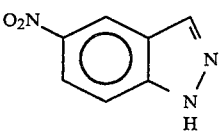
F-4
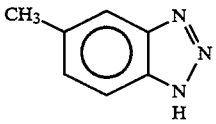
F-5
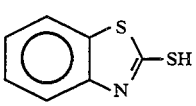
F-6
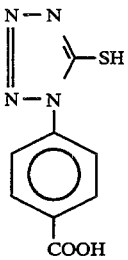
F-7
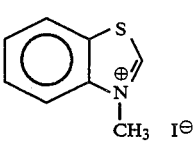
F-8
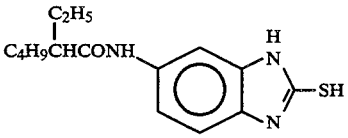
F-9
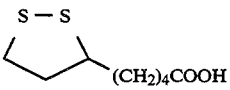
F-10

-continued

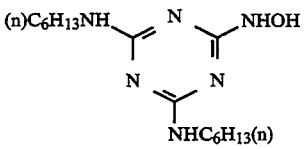

F-11

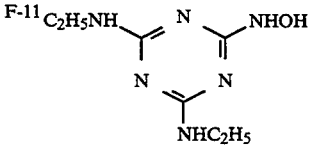

F-12

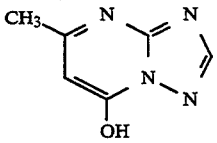

F-13

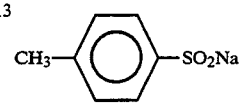

F-14

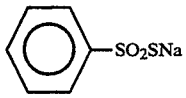

F-15

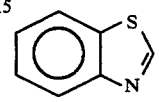

F-16

DYE-1

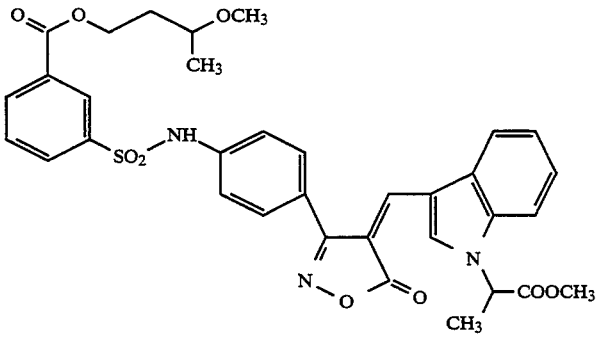

<Preparation of sample 102>

ExM-2 and ExM-4 in the 10th layer of the sample 101 were changed to ExM-5, and ExY-2 in the same layer to ExY-5, and the gradation upon white-light exposure was made equal to that of the sample 101 by controlling the coating amounts.

<Preparation of sample 103>

$1.5\times10^{-3}$ mol/molAg of KI was added to the 10th layer of the sample 101.

<Preparation of samples 104–115>

Samples 104 to 115 were prepared from the sample 101 by changing the sensitizing dyes used in the 10th layer as listed in Table 2 (to be presented later). A dye S-1 shown below was used in the sample 106.

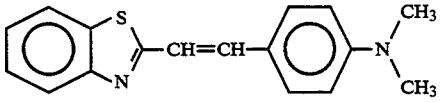

Dye S-1

The color reproduction, the sensitivity, a change in the sensitivity with storage, and the pressure fog of each of the samples 101 to 115 were evaluated by the method described below. The results are summarized in Table 2. In this example, the mixing ratio of the dyes are represented such that the total quantity of the dyes in ortho sensitization is 100%.

<Evaluation of the sensitivity>

Continuous magenta exposure was performed with white light, and the magenta density was measured after the following development. The sensitivity was evaluated by the reciprocal (a relative sensitivity of each sample assuming that the sensitivity of the sample 101 was 100) of an exposure amount by which a magenta density of 2.5 was given.

<Evaluation of change in the sensitivity during film storage>

Each sample was stored at a temperature of 30° C. and a humidity of 80% for one month, exposed in the same fashion as in the sensitivity evaluation, and developed. Thereafter, the magenta density of each sample was measured, and the difference from the sensitivity obtained by the samples not stored was checked.

<Evaluation of the resistance to pressure>

Each sample was moisture-conditioned at a temperature of 25° C. and a humidity of 55% for one day, and the resultant emulsion surface was scratched by applying a load of 5 g on a needle 0.1 mm in diameter. Thereafter, the samples were developed with the developing solution (to be described later). The magenta density in the scratched portion and that in a nonscratched portion of each sample were measured by a densitometer with a square aperture of 10 μm side. In this manner, a density change (ΔFog) from the density before to the density after the scratching was checked.

<Evaluation of the color reproduction>

In evaluation of the color reproduction, even if the faithfulness has been improved when attention is focused on one certain color alone, it is sometimes possible that the faithfulness has been degraded for another color. It is therefore necessary to evaluate a total color reproduction by evaluating all hues at the same time. A Pointer's method is known as an objective, quantitative method of evaluating the color reproduction of a reflected print image (M. R. POINTER; J. Photographic Science 34, 81–90, 1986).

The present inventors evaluated the color reproduction of the samples as follows in accordance with the Pointer's method.

A Macbeth color chart was photographed by using each sample under artificial daylight illumination with a Wratten 80B filter attached to a photoflood lamp. Thereafter, each resultant film was processed under the development conditions (to be described later) and printed on FUJICOLOR FA PAPER. The print density was controlled such that the densities of red, green, and blue (measured using an X-rite densitometer) of the fourth medium-gray status A agreed with the densities of the original chart. Each reflected print thus obtained and the original chart were measured using a color analyzer (Hitachi Ltd.), obtaining U', V', and Y of each color chip. These values were then converted into the values of hue. The difference between the color chip of the original chart and the color chip of each test sample was measured to obtain a hue index as follows in accordance with the Pointer's method. The closer the index to 100, the closer the color chip of the corresponding sample to the color chip of the original chart.

The method of development used was as follows.

| Process | Time | Temperature | Quantity of replenisher* | Tank volume |
|---|---|---|---|---|
| Color development | 3 min. 15 sec. | 38° C. | 45 ml | 10 l |
| Bleaching | 1 min. 00 sec. | 38° C. | 20 ml | 4 l |
| Bleach-fix | 3 min. 15 sec. | 38° C. | 30 ml | 8 l |
| Washing (1) | 40 sec. | 35° C. | Counter flow piping from (2) to (1) | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*A quantity of replenisher is represented by a quantity per meter of a 35-mm wide sample.

The compositions of the processing solutions are presented below.

| <Color developing solution> | Mother solution (g) | Replenishment solution (g) |
|---|---|---|
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxyethylamino)-2-methylaniline sulfate | 4.5 | 5.5 |
| Water to make | 1.0 l | 1.0 l |
| pH | 10.05 | 10.10 |

| <Bleaching solution> | Common for mother solution and replenishment solution (g) |
|---|---|
| Ferric ammonium ethylenediamine tetraacetate dihydrate | 120.0 |
| Disodium ethylenediaminetetraacetate | 10.0 |
| Ammonium bromide | 100.0 |
| Ammonium nitrate | 10.0 |
| Bleaching accelerator $\{(CH_3)_2N—CH_2CH_2—S\}_2.2HCl$ | 0.005 mol |
| Ammonium water (27%) | 15.0 ml |
| Water to make | 1.0 l |
| pH | 6.3 |

| <Bleach-fixing solution> | Common for mother solution and replenishment solution (g) |
|---|---|
| Ferric ammonium ethylenediamine tetraacetate dihydrate | 50.0 |
| Disodium ethylenediaminetetraacetate | 5.0 |
| Sodium sulfite | 12.0 |
| Ammonium thiosulfate aqueous solution (70%) | 240.0 ml |
| Ammonium water (27%) | 6.0 ml |
| Water to make | 1.0 l |
| pH | 7.2 |

| <Washing solution> | Common for mother solution and replenishment solution (g) |
|---|---|

Tap water was supplied to a mixed-bed column packed with an H type strongly acidic cation exchange resin (Amberlite IR-120B: available from Rohm & Haas Co.) and an OH type anion exchange resin (Amberlite IR-400) to set the concentrations of calcium and magnesium ions to 3 mg/l or less. Subsequently, 20 mg/l of sodium isocyanuric acid dichloride and 0.15 g/l of sodium sulfate were added. The pH of the solution ranged from 6.5 to 7.5.

| <Stabilizing solution> | Common for mother solution and replenishment solution (g) |
|---|---|
| Formalin (37%) | 2.0 ml |
| Polyoxyethylene-p-monononylphenyl-ether (average polymerization degree 10) | 0.3 |
| Disodium ethylenediaminetetraacetate | 0.05 |
| Water to make | 1.0 l |

TABLE 2

| Sample No. | Dyes (mixing ratio (mol %)) Conventional dye | Compound (I) | Compound (II) | Compound (III) | $\lambda_{-R}$ | $\lambda_G—\lambda_{-R}$ | Color reproduction (hue index) | Sensitivity | Sensitivity change with storage | Pressure-induced fog | |
|---|---|---|---|---|---|---|---|---|---|---|---|
| 101 | ExS-3 (100%) | / | / | / | 530 | 20 | 90 | 90 | −30 | 0.07 | Comparative example |
| 102 | ExS-3 (100%) | / | / | / | 530 | / | 60 | 90 | −30 | 0.07 | " |
| 103 | ExS-3 (100%) | / | / | / | 530 | 20 | 90 | 90 | −10 | 0.16 | " |
| 104 | ExS-4 (100%) | / | / | / | 550 | 5 | 60 | 100 | ±0 | 0.15 | " |
| 105 | / | I-3 (100%) | / | / | 530 | 20 | 80 | 60 | ±0 | 0.07 | " |
| 106 | / | I-3 | S-1 | / | 530 | 20 | 92 | 100 | −15 | 0.10 | " |

TABLE 2-continued

| Sample No. | Dyes (mixing ratio (mol %)) Conventional dye | Compound (I) | Compound (II) | Compound (III) | $\lambda_{-R}$ | $\lambda_G-\lambda_{-R}$ | Color reproduction (hue index) | Sensitivity | Sensitivity change with storage | Pressure-induced fog | |
|---|---|---|---|---|---|---|---|---|---|---|---|
| | | (100%) | (2%) | | | | | | | | |
| 107 | / | I-3 (98%) | IV-1 (2%) | / | 530 | 20 | 92 | 100 | ±0 | 0.07 | Present invention |
| 108 | / | I-15 (98%) | IV-10 (2%) | / | 532 | 20 | 92 | 100 | ±0 | 0.07 | " |
| 109 | / | I-14 (99.5%) | IV-2 (0.5%) | / | 530 | 20 | 92 | 95 | −5 | 0.07 | " |
| 110 | / | I-14 (98%) | IV-2 (2%) | / | 530 | 20 | 92 | 100 | ±0 | 0.07 | " |
| 111 | / | I-14 (90%) | IV-2 (10%) | / | 530 | 20 | 92 | 100 | ±0 | 0.07 | " |
| 112 | / | I-5 (98%) | IV-14 (2%) | / | 530 | 20 | 92 | 100 | ±0 | 0.09 | " |
| 113 | / | I-5 (48%) | IV-14 (2%) | III-4 (50%) | 520 | 25 | 96 | 105 | ±0 | 0.06 | " |
| 114 | / | I-5 (48%) | IV-14 (2%) | III-5 (50%) | 520 | 25 | 96 | 105 | ±0 | 0.06 | " |
| 115 | / | I-5 (48%) | V-1 (2%) | III-5 (50%) | 520 | 25 | 96 | 103 | ±0 | 0.06 | " |

As is evident from the results given in Table 2 above, it is possible to increase the sensitivity and improve the color reproduction by using the combination of compounds represented by Formulas (I) and (II) or of compounds represented by Formulas (I), (II), and (III). The addition of the conventional sensitizing dye ExS-3 to KI is unpreferred because the pressure fog increases, although it can decrease changes in the sensitivity during storage. Also, the sensitivity can be increased by using a styryl base in combination with a compound represented by Formula (I), but this results in large changes in the sensitivity during storage. On the other hand, the combination of the sensitizing dye (a compound represented by Formula (II)) coupled with a styryl base and a compound represented by Formula (I) makes it possible to realize a silver halide color photographic light-sensitive material which causes little changes in the sensitivity during storage and in the pressure fog, and has a high sensitivity and an improved color reproduction. The color reproduction is further improved by using a compound represented by Formula (III) together with these compounds.

Example 2

Emulsions identical with those prepared in Example 1 were coated on heat-treated, PET [2,6-naphthalenedicarboxylic acid/ethyleneglycol (100/100 molar ratio)] supports having the back surface of which a ferromagnetic substance for magnetic recording was coated with the thickness of 85 μm to give a yellow density of 0.12. Thus, the samples were prepared. Tests of the color reproduction, the storage stability, and the resistance to pressure were conducted for these samples. As a result, exceedingly good results were obtained as in Example 1.

Example 3

In the same emulsion preparation as performed in Example 1, sensitizing dyes were added after grain formation and before chemical sensitization, and chemical sensitization was performed. In this chemical sensitization, compounds represented by Formulas (I) and (II) or compounds represented by Formulas (I), (II), and (III) were added simultaneously. The emulsions thus prepared were coated and evaluated following the same procedures as in Example 1. Consequently, it was found that the sensitive materials using the compounds of the present invention had a high color reproduction, a high storage stability, and a high resistance to pressure, as in Example 1.

Example 4

<Preparation of emulsion K>Cubic seed emulsion

A silver nitrate 0.94 mol/l aqueous solution and a potassium bromide 0.94 mol/l aqueous solution were added by a double-jet method to a 1.5-l aqueous solution, which contained 0.2 g/l of potassium bromide and 25 g/l of gelatin, at a temperature of 45° C. with the pAg maintained at 7.3, thereby preparing an emulsion K consisting of silver bromide cubic grains with an equivalent-sphere diameter of 0.22 μm.

<Preparation of emulsion L>

A silver nitrate 0.94 mol/l aqueous solution and a potassium halide (Br 97%, I 3%) 0.94 mol/l aqueous solution were added by a double-jet method to the seed emulsion K at a temperature of 70° C. with the pAg maintained held at 7.3, thereby preparing silver bromoiodide cubic grains with an equivalent-sphere diameter of 0.33 μm and a size variation coefficient of 11%. After being washed with water by a conventional method, the resultant grains were optimally post-ripened with sodium thiosulfate, potassium thiocyanate, chloroauric acid, and dimethylselenourea, preparing an emulsion L.

<Preparation of emulsion M>

Following the same procedures as for the emulsion L, a 0.60-μm silver bromoiodide cubic emulsion M was prepared.

<Preparation of sample 301>

In the sample 101, the emulsions E, F, and G in the 10th layer were replaced with the emulsion L (coated in a silver amount of 04.0 g/m$^2$) and the emulsion M (coated in a silver amount of 0.45 g/m$^2$). The addition amount of the sensitizing dye was set to $4.2\times10^{-4}$ mol/molAg.

<Preparation of sample 302>

KI ($2.0\times10^{-3}$ mol/molAg) was added to the 10th layer of the sample 301.

<Preparation of samples 303–307>

The sensitizing dye ExS-3 in the 10th layer of the sample 301 was changed as shown in Table 3 below.

The color reproduction, the storage stability, and the resistance to pressure of each of the samples 301 to 306 were evaluated following the same procedures as in Example 1. The results are summarized in Table 3. In this example, the mixing ratio of the dyes are represented such that the total quantity of the dyes in ortho sensitization is 100%.

TABLE 3

| Sample No. | Dyes (mixing ratio (mol %)) Conventional dye | Compound (I) | Compound (II) | Compound (III) | $\lambda_{-R}$ | $\lambda_G-\lambda_{-R}$ | Color reproduction (hue index) | Sensitivity | Sensitivity change with storage | Pressure-induced fog | |
|---|---|---|---|---|---|---|---|---|---|---|---|
| 301 | ExS-3 (100%) | / | / | / | 530 | 20 | 91 | 100 | −35 | 0.06 | Comparative example |
| 302 | ExS-3 (100%) +KI | / | / | / | 530 | 20 | 91 | 100 | −15 | 0.13 | " |
| 303 | / | I-5 (100%) | / | / | 530 | 20 | 82 | 65 | ±0 | 0.05 | " |
| 304 | / | I-5 (98.5%) | IV-14 (1.5%) | / | 530 | 20 | 92 | 105 | ±0 | 0.06 | Present invention |
| 305 | / | I-5 (49%) | IV-14 (1%) | III-4 (50%) | 525 | 25 | 96 | 108 | ±0 | 0.05 | " |
| 306 | / | I-14 (49%) | IV-2 (1%) | III-4 (50%) | 525 | 25 | 96 | 108 | ±0 | 0.05 | " |
| 307 | / | I-5 (100%) | S-1 (1.5%) | / | 530 | 20 | 92 | 105 | −15 | 0.10 | Comparative example |

It is apparent from the results shown in Table 3 that the use of the compounds of the present invention made it possible to obtain silver halide color photographic light-sensitive materials improved in color reproduction, storage stability, and resistance to pressure.

What is claimed is:

1. A silver halide color photographic light-sensitive material which comprises, on a support, at least one blue-sensitive silver halide emulsion layer containing a yellow coupler, at least one green-sensitive silver halide emulsion layer containing a magenta coupler, and at least one red-sensitive silver halide emulsion layer containing a cyan coupler, and in which a weight-averaged wavelength ($\lambda_{-R}$) of a spectral sensitivity distribution of magnitude of an interimage effect which said silver halide emulsion layers except for all of said red-sensitive silver halide emulsion layers have on said red-sensitive layers over a range of 500 to 600 nm is 500 nm$<\lambda_{-R}<$560 nm, and a difference between a weight-averaged wavelength ($\lambda_G$) of a spectral sensitivity distribution of said at least one green-sensitive silver halide emulsion layer and $\lambda_{-R}$ is $\lambda_G-\lambda_{-R}\geqq 10$ nm, wherein at least one silver halide emulsion layer having the interimage effect on said red-sensitive silver halide emulsion layers is made contains a silver halide emulsion spectrally sensitized with at least one compound represented by Formula (I) below and at least one compound represented by Formula (II) below:

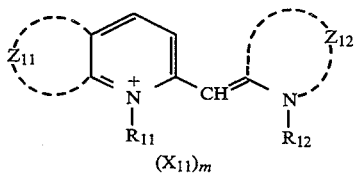

Formula (I)

wherein each of $R_{11}$ and $R_{12}$ represents an alkyl group, $Z_{11}$ represents a group of atoms required to form a benzene ring, $Z_{12}$ represents a group of atoms required to form a benzothiazole nucleus or a benzoselenazole nucleus, $X_{11}$ represents a charge-balancing counterion, and m represents 0 or 1, m being 0 when an intramolecular salt is to be formed;

$$(MET)_{k1}[(Q)_{k2}(ST)]_{k3}$$ Formula (II)

wherein MET represents a group of atoms having a methine dye structure, Q represents a divalent linking group consisting of an atom or an atomic group containing at least one of a carbon atom, a nitrogen atom, a sulfur atom, or an oxygen atom, ST represents a group of atoms having a styryl base structure, each of $k_1$ and $k_3$ is an integer of not less than 0, and $k_2$ is 0 or 1.

2. The silver halide color photographic light-sensitive material according to claim 1, comprising a silver halide emulsion spectrally sensitized with said at least one compound represented by said Formula (I), said at least one compound represented by said Formula (II), and at least one compound represented by Formula (III ) below:

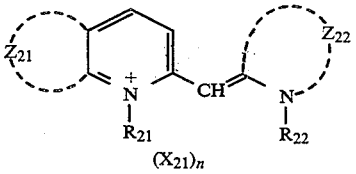

Formula (III)

wherein $R_{21}$, $R_{22}$, $Z_{21}$, $X_{21}$, and n have the same meanings as $R_{11}$, $R_{12}$, $Z_{11}$, $X_{11}$, and m, respectively, in Formula (I), and $Z_{22}$ represents a group of atoms required to form a benzoxazole nucleus or a naphthoxazole nucleus.

3. The silver halide color photographic light-sensitive material according to claim 1, wherein at least one atom of said group of atoms of $Z_{11}$ is substituted with an alkyl group having 1 to 8 carbon atoms, an alkoxy group having 1 to 8 carbon atoms, or an aryloxy group having 6 to 20 carbon atoms.

4. The silver halide color photographic light-sensitive material according to claim 1, wherein the 6-position of the benzene ring of $Z_{11}$ is substituted with an alkyl group having 1 to 3 carbon atoms.

5. The silver halide color photographic light-sensitive material according to claim 1, wherein $Z_{12}$ represents a benzothiazole nucleus whose 5-position is substituted with a halogen atom, an alkyl group having 1 to 8 carbon atoms, an alkoxy group having 1 to 8 carbon atoms, an alkylthio group having 1 to 8 carbon atoms, or an aryl group having 6 to 20 carbon atoms.

6. The silver halide color photographic light-sensitive material according to claim 1, wherein the alkyl group represented by $R_{11}$ and $R_{12}$ is sulfoethyl, sulfopropyl, sulfobutyl, carboxymethyl, or carboxyethyl.

7. The silver halide color photographic light-sensitive material according to claim 1, wherein in formula (I), $X_{11}$ is an inorganic anion, an organic acid anion, or a halogen ion.

8. The silver halide color photographic light-sensitive material according to claim 1, wherein in formula (I), $X_{11}$ is an inorganic cation or an organic cation.

9. The silver halide color photographic light-sensitive material according to claim 1, wherein Q is an ester group or an amido group.

10. The silver halide color photographic light-sensitive material according to claim 1, wherein $k_1$ is 1 or 2, and $k_3$ is 1, 2, 3, or 4.

11. The silver halide color photographic light-sensitive material according to claim 1, wherein in formula (II), MET is represented by Formula (IV) or (V) below:

Formula (IV)

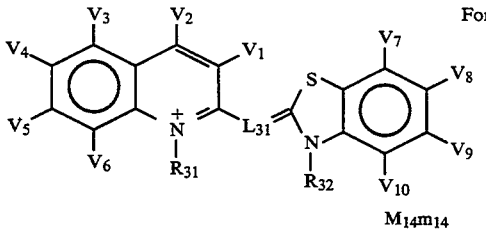

-continued

Formula (V)

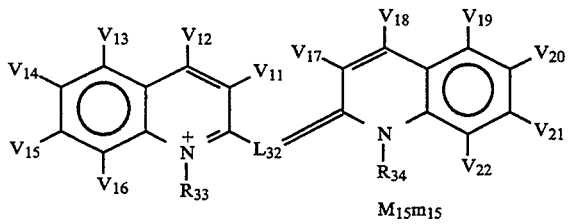

wherein each of $R_{31}$, $R_{32}$, $R_{33}$, and $R_{34}$ represents an alkyl group having 1 to 18 carbon atoms, each of $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$ and $V_{22}$ represents a hydrogen atom or a monovalent substituent group, each of $L_{31}$ and $L_{32}$ represents a methine group, each of $M_{14}$ and $M_{15}$ represents a charge-neutralizing counterion, and each of $m_{14}$ and $m_{15}$ represents a number equal to or larger than 0 which is needed to neutralize an intramolecular charge.

12. The silver halide color photographic light-sensitive material according to claim 11, wherein of $V_1$ to $V_{10}$, two neighboring substituent groups may be bonded to each other to form a ring.

13. The silver halide color photographic light-sensitive material according to claim 1, wherein ST is represented by Formula (VI):

Formula (VI)

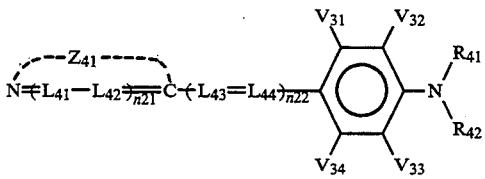

wherein $Z_{41}$ represents a group of atoms required to form a 5- or 6-membered nitrogen-containing heterocyclic ring, each of $V_{31}$, $V_{32}$, $V_{33}$, and $V_{34}$ represents a hydrogen atom or a monovalent substituent, each of $R_{41}$ and $R_{42}$ represents hydrogen, an alkyl group, an aryl group, or a heterocyclic group, each of $L_{41}$, $L_{42}$, $L_{43}$, and $L_{44}$ represents a methine group, and each of $n_{21}$ and $n_{22}$ represents 0 or 1.

14. The silver halide color photographic light-sensitive material according to claim 1, wherein the compound represented by formula (II) is present in an amount of 0.1 to 10 mol % with respect to the compound represented by Formula (I).

* * * * *